US005268261A

United States Patent [19]

Sakakibara et al.

[11] Patent Number: 5,268,261

[45] Date of Patent: Dec. 7, 1993

[54] SILVER HALIDE COLOR PHOTOGRAPHIC MATERIAL

[75] Inventors: Yoshio Sakakibara, Kanagawa; Shigehisa Tamagawa, Shizuoka; Osamu Takahashi, Kanagawa, all of Japan

[73] Assignee: Fuji Photo Film Co., Ltd., Ashigara, Japan

[21] Appl. No.: 708,443

[22] Filed: May 31, 1991

[30] Foreign Application Priority Data

Jun. 1, 1990 [JP] Japan ..... 2-143857
Mar. 28, 1991 [JP] Japan ..... 3-087291

[51] Int. Cl.[5] ..... G03C 1/46

[52] U.S. Cl. ..... 430/505; 430/538; 430/546; 430/551; 430/557; 430/558

[58] Field of Search ..... 430/538, 546, 505, 551, 430/557, 558

[56] References Cited

U.S. PATENT DOCUMENTS

| | | | |
|---|---|---|---|
| 4,255,491 | 3/1981 | Igarashi | 430/538 |
| 4,857,449 | 8/1989 | Ogawa et al. | 430/546 |
| 4,898,811 | 2/1990 | Wolff et al. | 430/546 |
| 4,902,600 | 2/1990 | Tamagawa et al. | 430/538 |
| 4,913,999 | 4/1990 | Tamagawa et al. | 430/538 |
| 5,023,169 | 6/1991 | Hirabayashi et al. | 430/557 |
| 5,057,405 | 10/1991 | Shiba et al. | 430/538 |

FOREIGN PATENT DOCUMENTS

| | | | |
|---|---|---|---|
| 0280238 | 8/1988 | European Pat. Off. . | |
| 0283324 | 9/1988 | European Pat. Off. . | |
| 3097941 | 4/1988 | Japan | 430/538 |

*Primary Examiner*—Charles L. Bowers, Jr.
*Assistant Examiner*—Thomas R. Neville
*Attorney, Agent, or Firm*—Burns, Doane, Swecker & Mathis

[57] ABSTRACT

A silver halide color photographic material comprises, a paper support having thereon a photographic constituent layer containing at least each one of a yellow coupler-containing layer, a magenta coupler-containing layer and a cyan coupler-containing layer, wherein that said magenta coupler is represented by formula (I), the weight ratio of a high boiling organic solvent in the same layer as said yellow coupler to said yellow coupler is 0.40 or less, and the pH value of the raw paper constituting said support is in the range of 5 to 9.

In a preferred embodiment, at least one of the yellow couplers is represented by formula (II). Another silver halide color photographic material is provided comprising on a paper support at least one yellow coupler-containing layer, one magenta coupler-containing layer and one cyan coupler-containing layer, wherein the material further comprises a magenta coupler represented by formula (I), a yellow coupler represented by formula (II) while and the pH value, of the raw paper constituting said support is in the range of 5 to 9. In addition, the weight ratio of a high boiling organic solvent in the same layer as said yellow coupler to said yellow coupler is preferably in the range of 0.2 to 0.38.

18 Claims, No Drawings

SILVER HALIDE COLOR PHOTOGRAPHIC MATERIAL

FIELD OF THE INVENTION

The present invention relates to a multi-layer silver halide color photographic material provided on a paper support. More particularly, the present invention relates to a multi-layer silver halide color photo-graphic material (hereinafter referred to as "light-sensitive material") which exhibits an excellent coloring property, improved color reproducibility, excellent image preservability and excellent hue during image preservation.

BACKGROUND OF THE INVENTION

In general, a silver halide color photographic material comprises, on a support, a multilayered light-sensitive layer consisting of three silver halide emulsion layers selectively sensitized to be sensitive to blue light, green light and red light, respectively. For example, a so-called color photographic paper (here-in-after referred to as "color paper") normally comprises a red-sensitive emulsion layer, a green-sensitive emulsion layer and a blue-sensitive emulsion layer in this order as viewed from the exposed side. Furthermore, an interlayer, such as protective layer and the like for the purpose of inhibiting color stain and absorbing ultraviolet light may be provided between the sensitive layers.

In order to form a color photographic image, photographic couplers for three colors, i.e., yellow, magenta and cyan are incorporated in a light-sensitive layer so that the light-sensitive material which has been exposed to light can be color-developed with an aromatic primary amine color developing agent. An oxidation product of the aromatic primary amine undergoes a coupling reaction with these couplers to give colored dyes. The coupling rate should be as high as possible. These couplers preferably exhibit an excellent coloring property so that it provides a high color density in a limited period of time. Furthermore, these colored dyes are required to be sharp cyan, magenta and yellow dyes which exhibit little subsidiary absorption and which give a color photographic image with an excellent color reproducibility.

On the other hand, the color photographic image thus formed is required to exhibit an excellent preservability under various conditions. In order to fullfill this requirement, it is essential that colored dyes with different hues exhibit a low deterioration or decoloration rate and the deterioration rate be as uniform as possible over all image density areas so that the color balance on the dye image shows no change.

To this end, so-called pyrazoloazole type magenta couplers as disclosed in U.S. Pat. Nos. 4,540,654 and 4,882,266 have been employed. Thus, color prints with excellent sensitometric characteristics, excellent reproducibility particularly in color red, little stain and excellent image preservability can be obtained.

On the other hand, yellow couplers which have heretofore been used have numerous disadvantages. For example, the maximum absorption wavelength of colored dye formed therefrom normally lies in the wavelength zone longer than that desired in view of color reproducibility. Moreover, the absorption in the long wavelength zone longer than 500 nm doesn't sharply drop to zero. Thus, these yellow couplers leave much to be desired in terms of reproducibility in hues such as yellow and green. In order to eliminate these difficulties, it has been proposed to use a coupler which produces a yellow dye that exhibits a maximum absorption in a relatively short wavelength range as disclosed in JP-A-1-173499 (the term "JP-A" as used herein means an "unexamined published Japanese patent application").

However, it has been found that when the above mentioned magenta coupler, particularly a magenta coupler with an effective coupling rate, and the above mentioned short wavelength type yellow coupler are used in combination, the color photograph thus formed exhibits a high density, little fog and an excellent color reproducibility but suffers from a color stain problem. In particular, the magenta density in yellow images increases during the prolonged storage of color photograph. It has thus been desired to maintain excellent color reproducibility during the storage of images.

SUMMARY OF THE INVENTION

It is therefore an object of the present invention to provide a silver halide color photographic material which exhibits a high density, little fog, and excellent color reproducibility and image preservability.

It is another object of the present invention to provide a silver halide color photographic material which provides a color photograph that can maintain its excellent image color reproducibility even when acted on by moisture and heat particularly during prolonged storage.

These and other objects of the present invention will become more apparent from the following detailed description and examples.

These objects of the present invention are accomplished with a silver halide color photographic material comprising a paper support having thereon a photographic layer containing at least each one of a yellow coupler-containing layer, a magenta coupler-containing layer and a cyan coupler-containing layer. In addition, the magenta coupler employed in the present invention is represented by formula (I), while the weight ratio of a high boiling organic solvent which is in the same layer as the yellow coupler, to the yellow coupler is 0.40 or less, and the pH value of the raw paper constituting said support is in the range of 5 to 9.

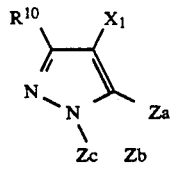

(I)

wherein $R^{10}$ represents a hydrogen atom or substituent group; $X_1$ represents a group releasable upon coupling reaction with an oxidation product of an aromatic primary amine developing agent; and Za, Zb and Zc each represents a methine, substituted methine, =N— or —N— group, with the proviso that one of Za-Zb bond and Zb-Zc bond is a double bond and the other is a single bond. Moreover, if Zb-Zc bond is a carbon-carbon bouble bond, it may form a part of the aromatic ring, and that $R^{10}$ or $X_1$ may form a dimer or higher polymer or, if Za, Zb or Zc is a substituted methine, it may form a dimer or higher polymer.

In a preferred embodiment, at least one of said yellow couplers is represented by formula (II):

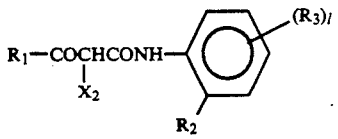

(II)

wherein $R_1$ represents an aryl group or tertiary alkyl group; $R_2$ represents a fluorine atom, alkyl group, aryl group, alkoxy group, aryloxy group, dialkylamino group, alkylthio group or arylthio group; $R_3$ represents a substituent group which can substitute for a benzene ring; $X_2$ represents a hydrogen atom or a group releasable upon coupling reaction with an oxidation product of an aromatic primary amine developing agent; and l represents 0, 1, 2, 3 or 4, with the proviso that if l is 2 or more, the plurality of $R_3$'s may be the same or different.

These and other objects of the present invention are also accomplished with a silver halide color photographic material comprising, on a paper support, at least each one of yellow coupler-containing layer, magenta coupler-containing layer and cyan coupler-containing layer, wherein the material includes a magenta coupler represented by formula (I) while a yellow coupler represented by formula (II) while the pH value of the raw paper constituting said support is in the range of 5 to 9.

DETAILED DESCRIPTION OF THE INVENTION

The magenta coupler of the present invention represented by formula (I) will be further described hereinafter.

In the magenta dye-forming coupler represented by formula (I), the polymer means a compound containing two or more groups represented by formula (I) per molecule. Examples of such a polymer include bis units and polymer couplers. These polymer couplers include homopolymers consisting of monomers (preferably containing vinyl groups, hereinafter referred to as "vinyl monomer") containing portions represented by the general formula (Ia). In the alternative, these monomers may form a copolymerizable polymer with a non-coloring ethylenic monomer which doesn't undergo coupling with an oxidation product of an aromatic primary amine developing agent.

Preferred among these magenta dye-forming couplers represented by formula (I) are those represented by formulae (Ia), (Ib), (Ic), (Id), (Ie), (Ic), (If) and (Ig):

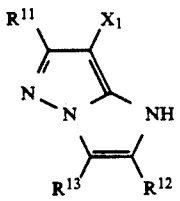

(Ia)

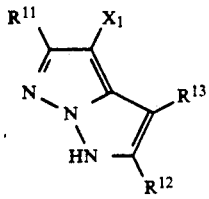

(Ib)

-continued

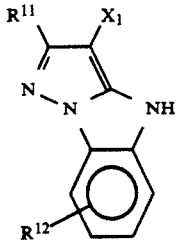

(Ic)

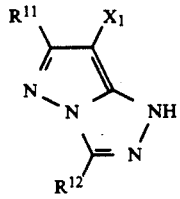

(Id)

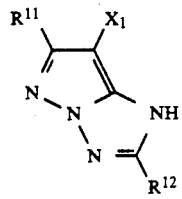

(Ie)

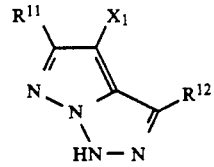

(If)

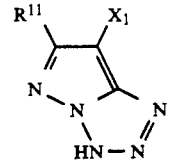

(Ig)

Among the couplers represented by formula (Ia) to (Ig), those preferred couplers are (Ia), (Id) and (Ie). More preferred among these couplers is (Ie).

In formulae (Ia) to (Ig), $R^{11}$, $R^{12}$ and $R^{13}$ may be the same or different and each represents a hydrogen atom, a halogen atom, alkyl group, aryl group, heterocyclic group, cyano group, alkoxy group, aryoxy group, heterocyclic oxy group, acyloxy group, carbamoyloxy group, silyloxy group, sulfonyloxy group, acylamino group, anilino group, ureide group, imide group, sulfamoylamino group, carbamoylamino group, alkylthio group, arylthio group, heterocyclic thio group, alkoxycarbonylamino group, aryloxycarbonylamino group, sulfonamide group, carbamoyl group, acyl group, sulfamoyl group, sulfonyl group, sulfinyl group, alkoxycarbonyl group, or aryloxycabonyl group. $X_1$ represents a halogen atom, carboxyl group or a group which is connected to the carbon atom in the coupling-position via an oxygen atom, nitrogen atom or sulfur atom and can be released therefrom upon coupling reaction. $X_1$ is preferably a halogen atom or coupling-releasable group which is connected to the carbon atom in the coupling-position via a sulfur atom. R'', $R_{12}$, $R_{13}$ or $X_1$ may be a divalent group to form a bis group or higher polymer.

The magenta dye-forming coupler of the present invention may be in the form of a polymer coupler comprising coupler residues represented by formulae (Ia) to (Ig) present in the main chain or side chain in the polymer, preferably a polymer derived from vinyl monomers containing a portion represented by one of these formulae. In this case, $R^{11}$, $R^{12}$, $R^{13}$ or $X_1$ represents a vinyl group or connecting group.

More particularly, $R^{11}$, $R^{12}$ and $R^{13}$ each represents a hydrogen atom, halogen atom (e.g., chlorine, bromine), alkyl group (e.g., methyl, propyl, t-butyl, trifluoromethyl, tridecyl, 3-(2,4-di-t-amylphenoxy) propyl, allyl, 2-dodecyloxyethyl, 3-phenoxypropyl, 2-hexylsulfonylethyl, cyclopentyl, benzyl), aryl group (e.g., phenyl, 4-t-butylphenyl, (2,4-di-t-amylphenyl, 4-tetradecanamidophenyl), heterocyclic group (e.g., 2-furyl, 2-thienyl, 2-pyrimidinyl, 2-benzothiazolyl), cyano group, alkoxy group (e.g., methoxy, ethoxy, 2-methoxyethoxy, 2-dodecyloxyethoxy, 2-methanesulfonylethoxy), aryloxy group (e.g., phenoxy, 2-methylphenoxy, 4-t-butylphenoxy), heterocyclic oxy group (e.g., 2-benzimidazolyloxy), acyloxy group (e.g., acetoxy, hexadecanoyloxy), carbamoyloxy group (e.g., N-phenylcarbamoyloxy, N-ethylcarbamoyloxy), silyloxy group (e.g., trimethylsilyloxy), sulfonyloxy group (e.g., dodecylsulfonyloxy), acylamino group (e.g., acetamide, benzamide, tetradecanamide, α-(2,4-di-t-amylphenoxy)butylamino, γ-(3-t-butyl-4-hydroxy-phenoxy)-butylamide, α-{4-(4-hydroxyphenylsulfonyl)-phenoxy} decanamide), anilino group (e.g., phenylamino, 2-chloroanilino, 2-chloro-5-tetradecanamidoanilino, 2-chloro-5-dodecyloxycarbonylanilino, N-acetylanilino, 2-chloro-5-{α-(3-t-butyl-4-hydroxyphenoxy)-dodecanamido}-anilino), ureide group (e.g., phenylureide, methyl-ureide, N,N-dibutylureide), imide group (e.g., N-succinimide, 3-benzylhydantoinyl, 4-(2-ethylhexanoyl-amino)phthalimide), sulfamoylamino group (e.g., N,N-di-propylsulfamoylamino, N-methyldecylsulfamoylamino), alkylthio group (e.g., methylthio, octylthio, tetradecylthio, 2-phenoxyethylthio, 3-phenoxypropylthio, 3-(4-t-butylphenoxy)propylthio), arylthio group (e.g., phenylthio, 2-butoxy-5-t-octylphenylthio, 3-pentadecylphenylthio, 2-carboxyphenylthio, 4-tetradecanamidophenylthio), heterocyclic thio group (e.g., 2-benzothiazolylthio), alkoxycarbonylamino group (e.g., methoxycarbonylamino, tetradecyloxycarbonylamino), aryloxycarbonylamino group (e.g., phenoxycarbonylamino, 2,4-di-t-butylphenoxycarbonylamino), sulfonamide group (e.g., methanesulfonamide, hexadecansulfonamide, benzenesulfonamide, p-toluenesulfonamide, octadecansulfonamide, 2-methyloxy-5-t-butylbenzenesulfonamide), carbamoyl group (e.g., N-ethylcarbamoyl, N,N-dibutylcarbamoyl, N-(2-dodecyloxyethyl)carbamoyl, N-methyl-N-dodecylcarbamoyl, N-{3-(2,4-di-t-amylphenoxy)-propyl}carbamoyl), acyl group (e.g., acetyl group, (2,4-di-t-aminophenoxy)acetyl, benzoyl), sulfamoyl group (e.g., N-ethylsulfamoyl, N,N-dipropylsulfamoyl, N-(2-dodecyloxyethyl)sulfamoyl, N-ethyl-N-dodecylsulfamoyl, N,N-diethylsulfamoyl), sulfonyl group (e.g., methanesulfonyl, octanesulfonyl, benzenesulfonyl, toluenesulfonyl), sulfinyl group (e.g., octanesulfinyl, dodecylsulfinyl, phenylsulfinyl), alkoxycarbonyl group (e.g., methoxycarbonyl, butyloxycarbonyl, dodecyloxycarbonyl, octadecyloxycarbonyl), or aryloxycarbonyl group (e.g., phenyloxycarbonyl, 3-pentadecyloxycarbonyl). $X_1$ represents a halogen atom (e.g., chlorine, bromine, iodine), carboxyl group, group which is connected to the aromatic ring via oxygen atom (e.g., acetoxy, propanoyloxy, benzoyloxy, 2,4-dichlorobenzoyloxy, ethoxyoxaloyloxy, pyruvinyloxy, cinnamoyloxy, phenoxy, 4-cyanophenoxy, 4-methanesulfonamidophenoxy, 4-methanesulfonylphenoxy, 4-methanesulfonylphenoxy, α-naphthoxy, 3-pentadecylphenoxy, benzyloxycarbonyloxy, ethoxy, 2-cyanoethoxy, benzyloxy, 2-phenethyloxy, 2-phenoxyethoxy, 5-phenyltetrazolyloxy, 2-benzothiazolyloxy), group which is connected to the aromatic ring via nitrogen atom (e.g., benzenesulfonamide, N-ethyltoluenesulfonamide, heptafluorobutanamide, 2,3,4,5,6-pentafluorobenzamide, octanesulfonamide, p-cyanophenyl-ureide, N,N-diethylsulfamoylamino, 1-piperidyl, 5,5-dimethyl-2,4-dioxo-3-oxazolidinyl, 1-benzyl-ethoxy-3-hydantoinyl, 2N-1,1-dioxy-3(2H)-oxo-1,2-benzisothiazolyl, 2-oxo-1,2-dihydro-1-pyridinyl, imidazolyl, pyrazolyl, 3,5-diethyl-1,2,4-triazol-1-yl, 5- or 6-bromobenzotriazol-1-yl, 5-methyl-1,2,3,4-triazol-1-yl, benzimidazolyl, 3-benzyl-1-hydantoinyl, 1-benzyl-5-hexadecyloxy-3-hydantoinyl, 5-methyl-1-tetrazolyl), arylazo group (e.g., 4-methoxyphenylazo, 4-pivaloylaminophenylazo, 2-naphthylazo, 3-methyl-4-hydroxyphenylazo), or group which is connected to the aromatic ring via sulfur atom (e.g., phenylthio, 2-carboxyphenylthio, 2-methoxy-5-t-octylphenylthio, 4-methanesulfonylphenylthio, 4-octanesulfonamidophenylthio, 2-butoxyphenylthio, 2-(2-hexanesulfonylethyl)-5-t-octylphenylthio, benzylthio, 2-cyanothio, 1-ethoxycarbonyltridecylthio, 5-phenyl-2,3,4,5-tetrazolylthio, 2-benzothiazolylthio, 2-dodecylthio-5-thiophenylthio, 2-phenyl-3-dodecyl-1,2,4-triazolyl-5-thio).

In the couplers represented by the general formulae (Ia) and (Ib), $R^{12}$ and $R^{13}$ may be COnnected together to form a 5- to 7-membered ring.

If $R^{11}$, $R^{12}$, $R^{13}$ or X is a divalent group which forms a bis unit, $R^{11}$, $R^{12}$, and $R^{13}$ preferably each represents a substituted or unsubstituted alkylene group (e.g., methylene, ethylene, 1,10-decylene, $—CH_2CH_2—O—CH_2CH_2—$), substituted or unsubstituted phenylene group (e.g., 1,4-phenylene, 1,3-phenylene,

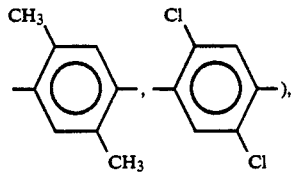

$—NHCO—R^{14}—CONH—$ group (wherein $R_{14}$ represents a substituted or unsubstituted alkylene group or phenylene group such $—NHCOCH_2CH_2CONH—$, $—NHCOCH_2C—(CH_3)_2—CH_2CONH—$, $—NHCO—C_6H_4—CONH—$), or $—S—R_{14}—S$-group (wherein $R_{14}$ represents a substituted or unsubstituted alkylene group such as $—S—CH_2CH_2—S$, $—S—CH_2C(CH_3)_2—CH_2—S—$), and X represents a divalent group obtained by rendering the above mentioned monovalent group divalent.

If the couplers represented by formulae (Ia), (Ib), (Ic), (Id), (Ie), (If) and (Ig) are contained in the vinyl monomer, examples of the connecting group represented by $R^{11}$, $R^{12}$, $R^{13}$ or X include those formed by combining groups selected from the group consisting of alkylene group (substituted or unsubstituted alkylene group, e.g., methylene, ethylene, 1,10-decylene, $—CH_2CH_2OCH_2CH_2—$), phenylene group (substituted or unsubstituted phenylene group such as 1,4-phenylene, 1,3-phenylene,

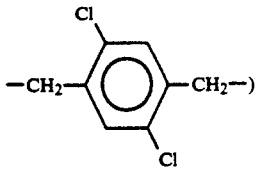

—NHCO—, —CONH—, —O—, —OCO—), and aralkylene group (e.g., $—CH_2—C_6H_4—CH_2—$, $—CH_2CH_2—C_6H_4—CH_2CH_2—$).

Preferred examples of the connecting group include —NHCO—, $—CH_2CH_2—$, $—CH_2CH_2CH_2—C_6H_4—NHCO—$, $C_6H_5—NHCO—$, $—CH_2CH_2NHCO—$, $—CH_2CH_2—O—CO—$, $—CONH—CH_2CH_2NHCO—$, $—CH_2CH_2O—CH_2CH_2NHCO—$, and $—CH_2CH_2—C_6H_4—CH_2NHCO—$. The vinyl group may contain substituents other than those represented by formulae (Ia), (Ib), (Ic), (Id), (Ie), (If) and (Ig). Preferred examples of such substituents include hydrogen atom, chlorine atom, and $C_{1-4}$ lower alkyl group (e.g., methyl, ethyl).

The monomer containing the coupler represented by formula (Ia), (Ib), (Ic), (Id), (Ie), (If) or (Ig) may form a copolymer with a non-coloring ethylenic monomer which doesn't undergo coupling with an oxidation product of an aromatic primary amine developing agent.

Examples of the non-coloring ethylenic monomer include acrylic acid, α-chloroacrylic acid, α-alkylacrylic acid (e.g., methacrylic acid), ester or amide derived from these acrylic acids (e.g., acrylamide, n-butylacrylamide, t-butylacrylamide, diacetonacrylamide, methacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, β-hydroxy methacrylate), methylene dibisacrylamide, vinyl ester (e.g., vinyl acetate, vinyl propionate, vinyl laurate), acrylonitrile, methacrylonitrile, aromatic vinyl compound (e.g., styrene and derivative thereof, vinyl toluene, divinyl benzene, vinyl acetophenone, sulfostyrene), itaconic acid, citraconic acid, crotonic acid, vinylidene chloride, vinyl alkyl ether (e.g., vinyl ethyl ether), maleic acid, maleic anhydride, maleate ester, N-vinyl-2-pyrrolidone, N-vinylpyridine, and 2- and 4-vinylpyridine. Two or more of these non-coloring ethylenically unsaturated monomers can be used in combination. Examples of such a combination include a combination of n-butyl acrylate and methyl acrylate, a combination of styrene and methacrylic acid, and a combination of methyl acrylate and diacetone acrylmide.

As is known in the field of polymer color couplers, the non-coloring ethylenically unsaturated monomers which is to be copolymerized with a solid water-insoluble monomeric coupler can be selected such that the physical and/or chemical properties, e.g., solubility, compatibility with a binder for photographic colloidal composition such as gelatin, flexibility and thermal stability, of the copolymer thus formed are favorably affected.

The polymer coupler to be used in the present invention may be water-soluble or water-insoluble, preferably a polymer coupler latex.

Specific examples of pyrazoloazole magenta couplers represented by formula (I) to be used in the present invention and synthesis methods thereof are described in JP-A-59-162548, JP-A-60-43659, JP-A-59-171956, JP-A-60-172982, and JP-A-60-33552, and U.S. Pat. No. 3,061,432.

Preferred among pyrazoloazole magenta couplers represented by formula (I) are pyrazolotriazole couplers. Particularly preferred among these pyrazolotriazole couplers are those wherein branched alkyl groups are connected to the 2-, 3- or 6-position and there is contained a halogen atom as releasable group or wherein alkyl or aryl groups are connected to the 2- or 3-positions and alkoxy or aryoxy groups are connected to the 6-position and there is contained a releasable group connected thereto via a sulfur atom.

The magenta coupler represented by formula (I) to be used in the present invention is normally incorporated in the silver halide emulsion layer in an amount of 0.005 to 4 mol, preferably 0.05 to 2 mol per mol of silver halide.

Specific examples of magenta couplers are set forth below, but the present invention should not be construed as being limited thereto.

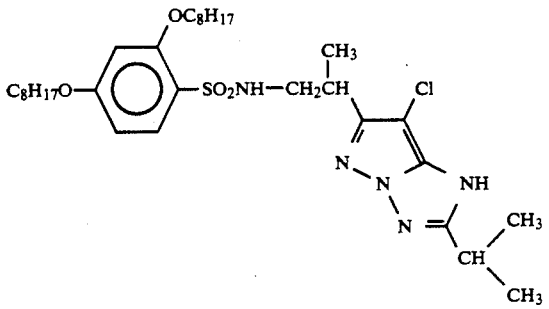

(I-1)

-continued
(I-2)
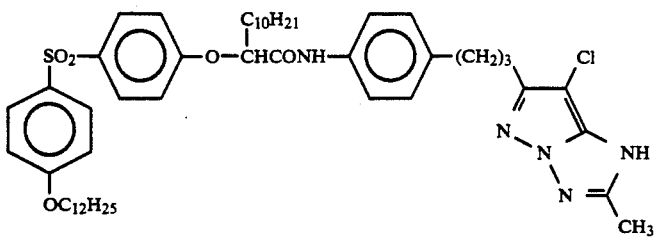
(I-3)
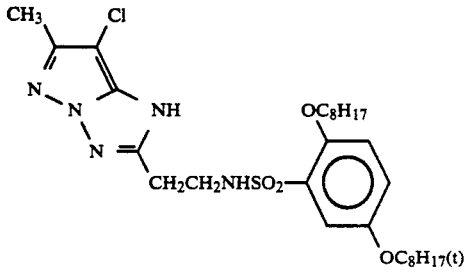
(I-4)
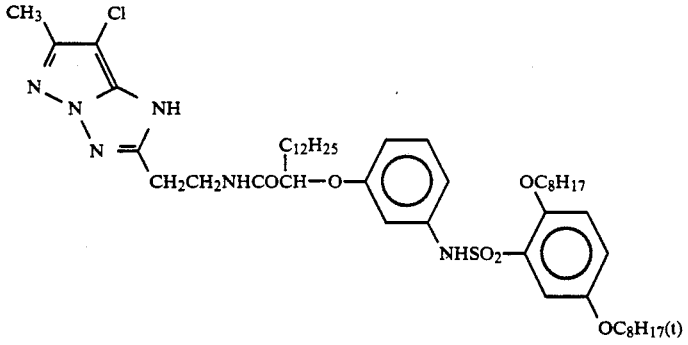
(I-5)
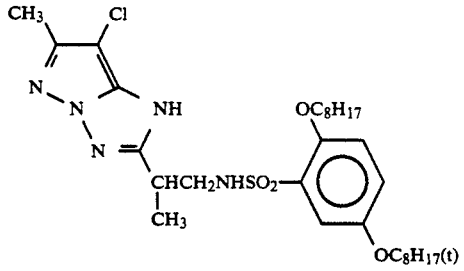
(I-6)
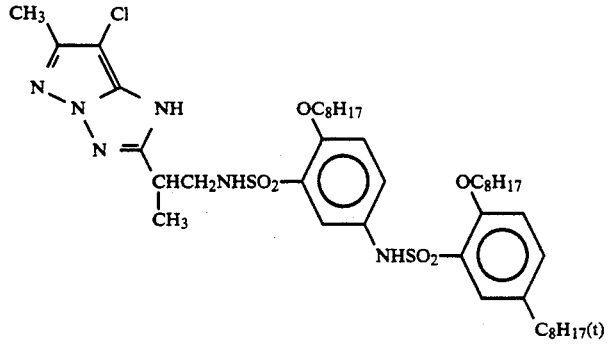

-continued
(I-7)
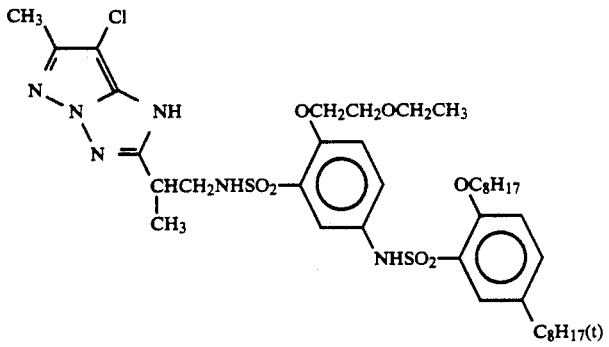
(I-8)
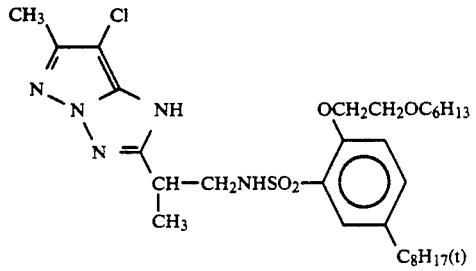
(I-9)
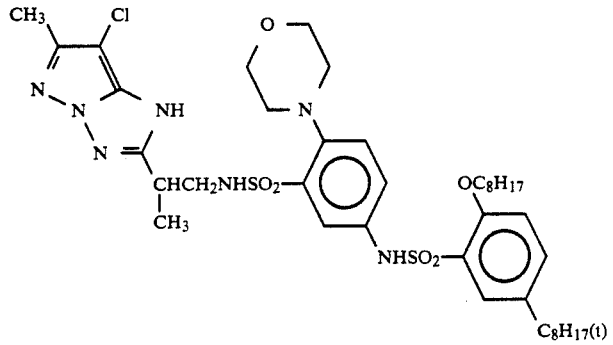
(I-10)
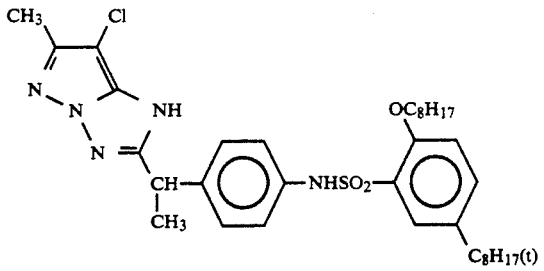
(I-11)
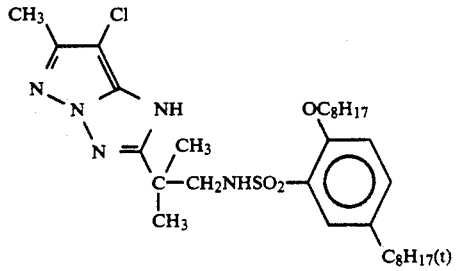

-continued
(I-12)
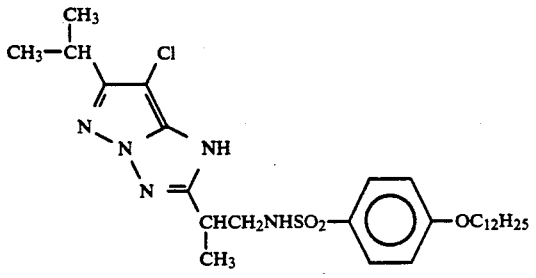
(I-13)
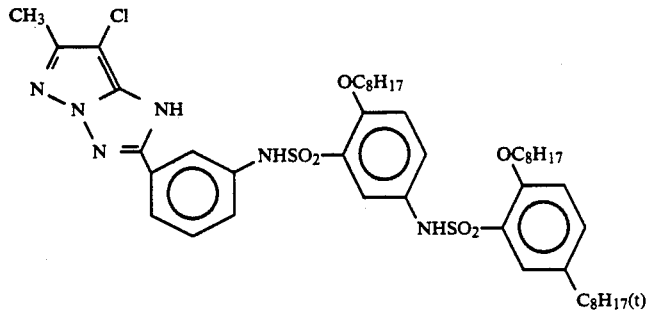
(I-14)
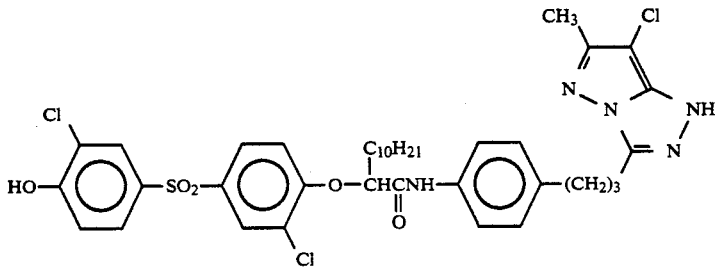
(I-15)
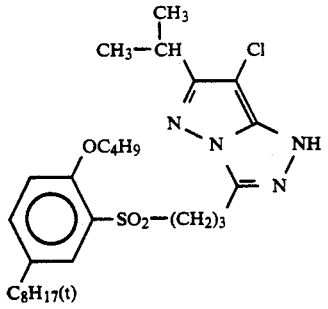
(I-16)
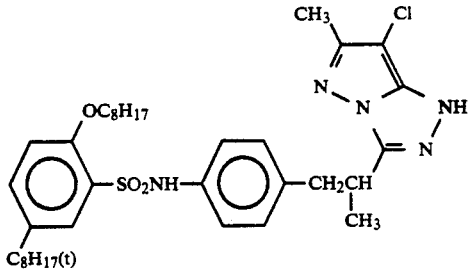

-continued
(I-17)
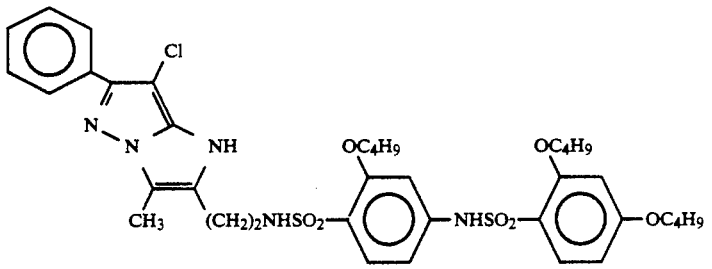
(I-18)
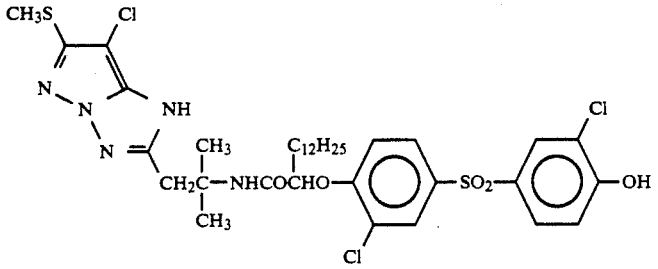
(I-19)
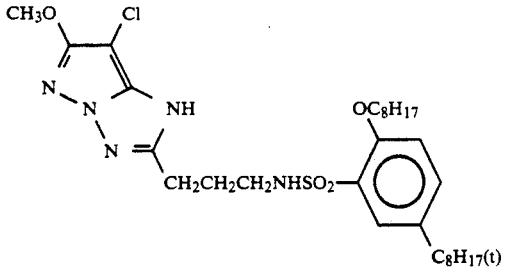
(I-20)
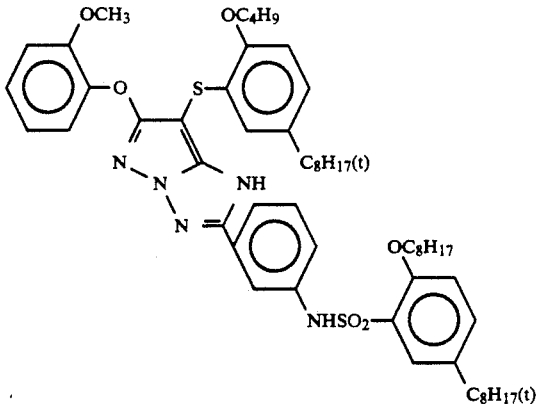

-continued
(I-21)
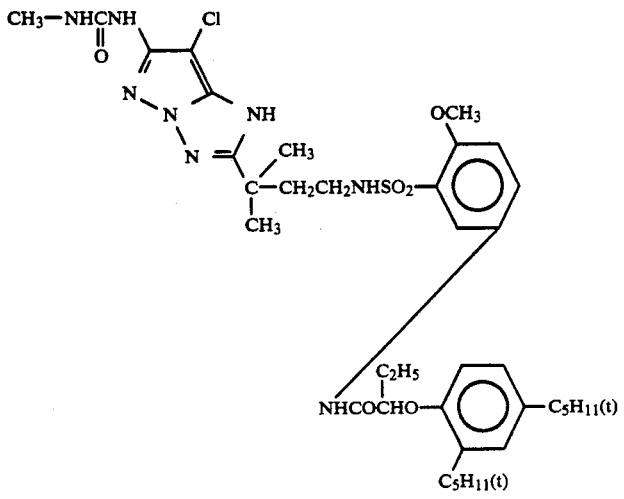
(I-22)
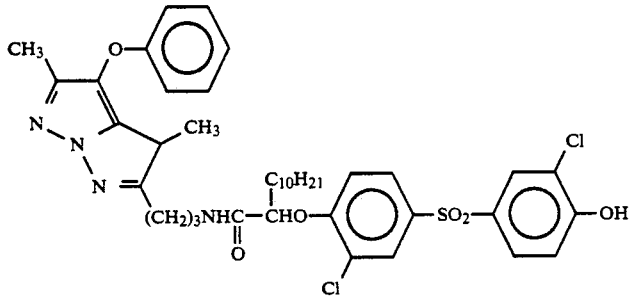
(I-23)
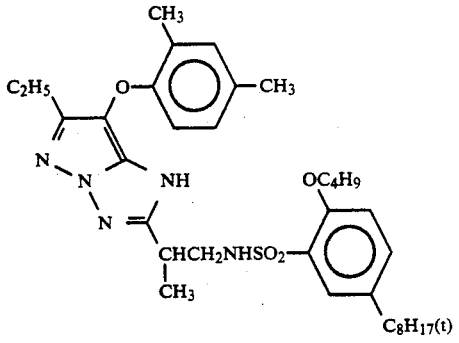
(I-24)
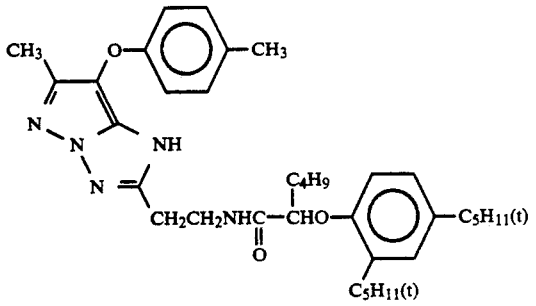

-continued
(I-25)
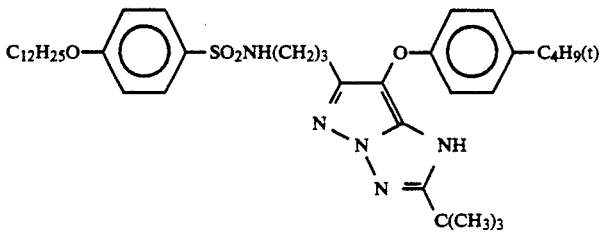
(I-26)
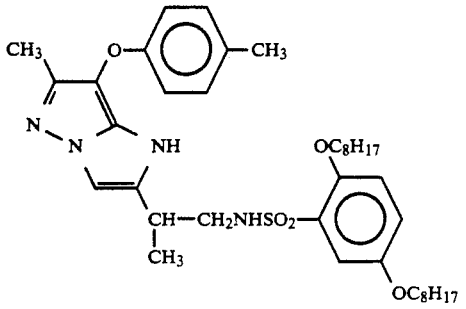
(I-27)
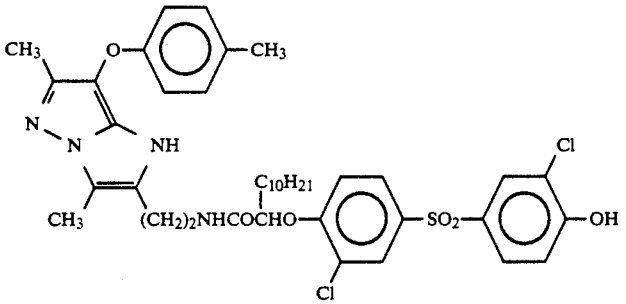
(I-28)
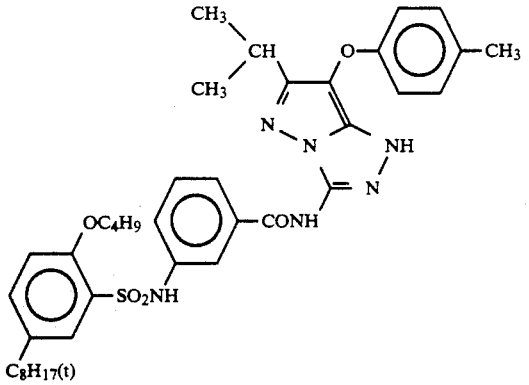
(I-29)
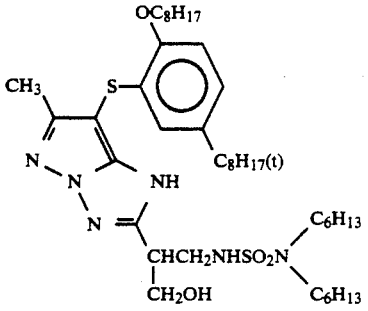

-continued
(I-30)
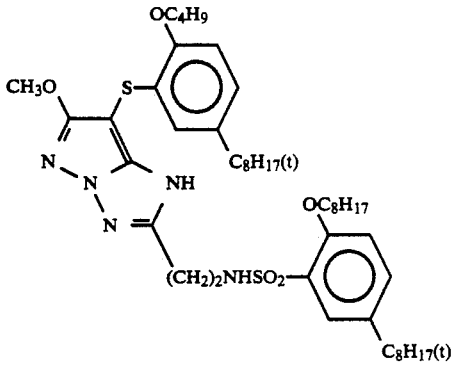
(I-31)
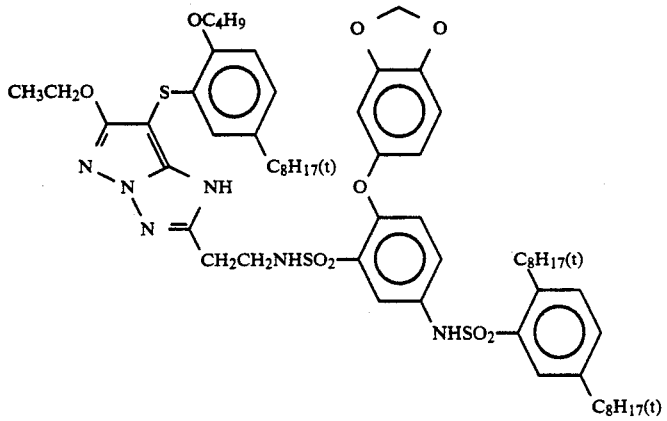
(I-32)
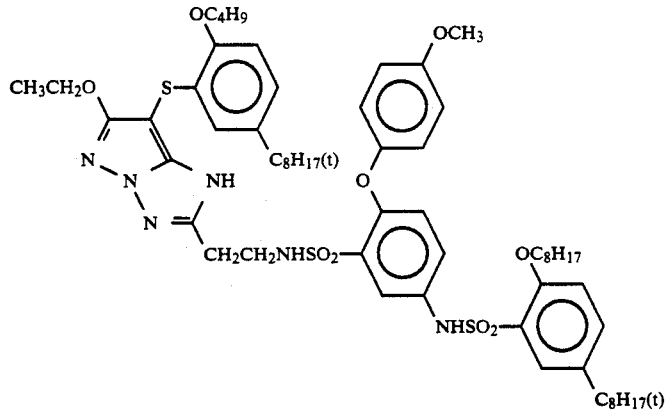
(I-33)
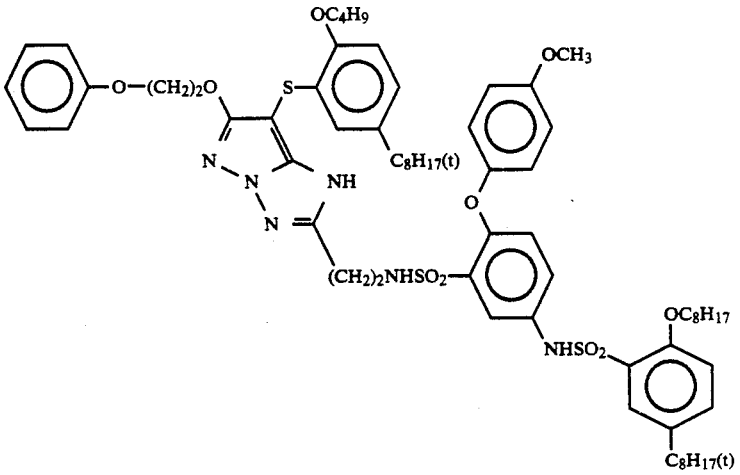

-continued
(I-34)
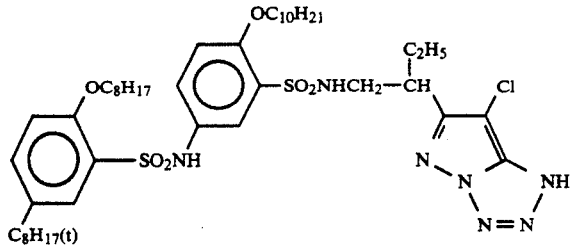
(I-35)
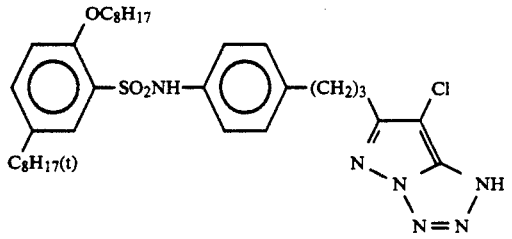
(I-36)
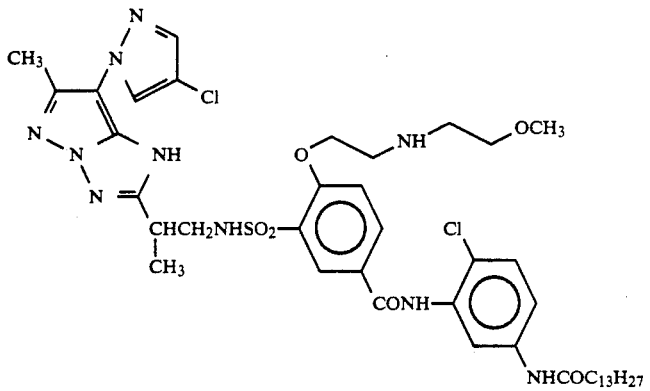
(I-37)
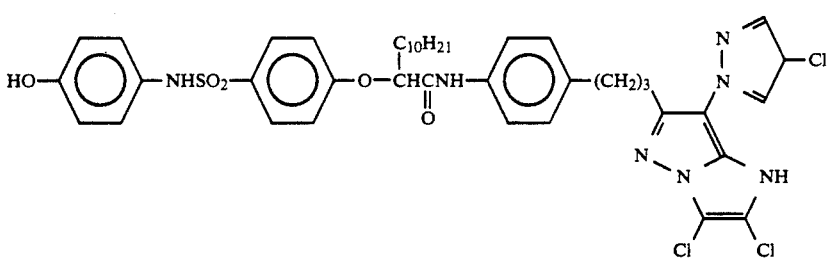
(I-38)
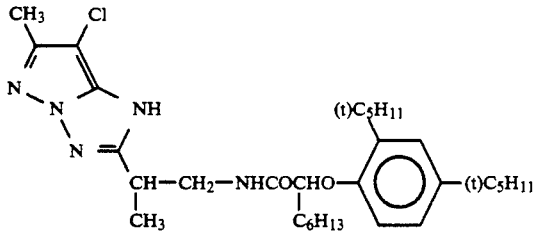
(I-39)
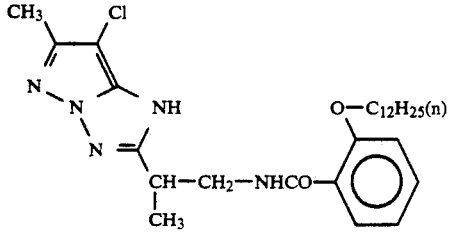

-continued

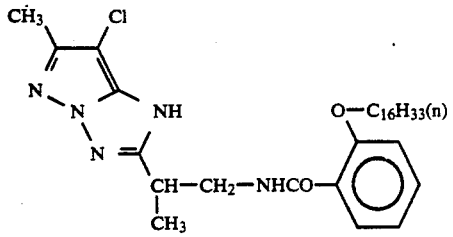

(I-40)

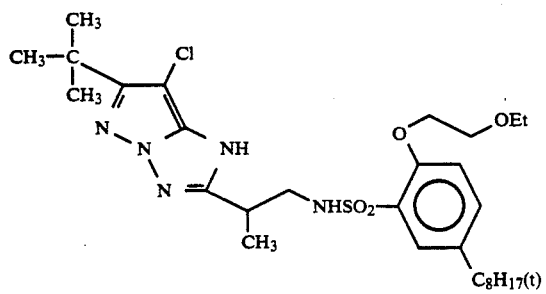

(I-41)

The magenta coupler of the present invention to be coated on the support is preferably in the range of $2\times10^{-5}$ to $1\times10^{-2}$ mol/m$^2$, more preferably $4\times10^{-5}$ to $5\times10^{-3}$ mol/m$^2$.

The compound [II] to be used in the present invention is further described hereinafter.

In the general formula [II], $R_1$ is preferably a $C_{6-24}$ aryl group (e.g., phenyl, p-tolyl, o-tolyl, 4-methoxyphenyl, 2-methoxyphenyl, 4-butoxyphenyl, 4-octyloxyphenyl, 4-hexadecyloxyphenyl, 1-naphthyl) or $C_{4-24}$ tertiary alkyl group (e.g., t-butyl, t-pentyl, t-hexyl, 1,1,3,3-tetramethylbutyl, 1-adamanthyl, 1,1-dimethyl-2-chloroethyl, 2-phenoxy-2-propyl, bicyclo(2,2,2)octan-1-yl).

In formula [II], $R_2$ is preferably a fluorine atom, Cl-24 alkyl group (e.g., methyl, ethyl, isopropyl, t-butyl, cyclopentyl, n-octyl, n-hexadecyl, benzyl), $C_{6-24}$ aryl group (e.g., phenyl, p-tolyl, o-tolyl, 4-methoxyphenyl), $C_{1-24}$ alkoxy group (e.g., methoxy, ethoxy, butoxy, n-octyloxy, n-tetradecyloxy, benzyloxy, methoxyethoxy), $C_{6-24}$ aryloxy group (e.g., phenoxy, p-tolyloxy, o-tolyloxy, p-methoxyphenoxy, p-dimethylaminophenoxy, m-pentadecylphenoxy), $C_{2-24}$ dialkylamino group (e.g., dimethylamino, diethylamino, pyrrolidino, piperidino, morpholino), $C_{1-24}$ alkylthio group (e.g., methylthio, butylthio, n-octylthio, n-hexadecylthio) or $C_{6-24}$ arylthio group (e.g., phenylthio, 4-methoxyphenylthio, 4-t-butylphenylthio, 4-dodecylphenylthio).

In formula [II], $R_3$ is preferably a halogen atom (e.g., fluorine, chlorine, bromine, iodine), $C_{1-24}$ alkyl group (e.g., methyl, t-butyl, n-dodecyl), $C_{6-24}$ aryl group (e.g., phenyl, p-tolyl, p-dodecyloxyphenyl), $C_{1-24}$ alkoxy group (e.g., methoxy, n butoxy, n-octyloxy, n-tetradecyloxy, benzyloxy, methoxyethoxy), $C_{6-24}$ aryloxy group (e.g., phenoxy, p-t-butylphenoxy, 4-butoxyphenoxy), $C_{2-24}$ alkoxycarbonyl group (e.g., ethoxycarbonyl, dodecyloxycarbonyl, 1-(dodecyloxycarbonyl)ethoxycarbonyl), $C_{7-24}$ aryloxycarbonyl group (e.g., phenoxycarbonyl, 4-t-octylphenoxycarbonyl, 2,4-di-t-pentylphenoxycarbonyl), $C_{1-24}$ carbonamide group (e.g., acetamide, pivaloylamino, benzamide, 2-ethylhexanamide, tetradecanamide, 1-(2,4-di-t-pentylphenoxy)butanamide, 3-(2,4-di-t-pentylphenoxy)butanamide, 3-dodecylsulfonyl-2-methylpropanamide), $C_{1-24}$ sulfonamide group (e.g., methanesulfonamide, p-toluenesulfonamide, hexadecansulfonamide), $C_{1-24}$ carbamoyl group (e.g., N-methylcarbamoyl, N-tetradecylcarbamoyl, N,N-dihexylcarbamoyl, N-octadecyl-N-methylcarbamoyl, N-phenylcarbamoyl), $C_{0-24}$ sulfamoyl group (e.g., N-methylsulfamoyl, N-phenylsulfamoyl, N-acetylsulfamoyl, N-propanoylsulfamoyl, N-hexadecylsulfamoyl, N,N-dioctylsulfamoyl), $C_{1-24}$ alkylsulfonyl group (e.g., methylsulfonyl, benzylsulfonyl, hexadecylsulfonyl), $C_{6-24}$ arylsulfonyl group (e.g., phenylsulfonyl, p-tolylsulfonyl, p-dodecylsulfonyl, p-methoxysulfonyl), $C_{1-24}$ ureide group (e.g., 3-methylureide, 3-phenylureide, 3,3-dimethylureide, 3-tetradecylureide), $C_{0-24}$ sulfamoylamino group (e.g., N,N-dimethylsulfamoylamino), $C_{2-24}$ alkoxycarbonylamino group (e.g., methoxycarbonylamino, isobutoxycarbonylamino, dodecyloxycarbonylamino), nitro group, $C_{1-24}$ heterocyclic group (*e.g., 4-pyridyl, 2-thenyl, phthalimide, octadecylsuccinimide), cyano group, $C_{1-24}$ acyl group (e.g., actyl, benzoyl, dodecanoyl), $C_{1-24}$ acyloxy group (e.g., acetoxy, benzoyloxy, dodecanoyloxy), $C_{24}$ alkylsulfonyloxy group (e.g., methylsulfonyloxy, hexadecylsulfonyloxy) or $C_{6-24}$ arylsulfonyloxy group (e.g., p-toluenesulfonyloxy, p-dodecylphenylsulfonyloxy).

In formula [II], l is preferably an integer 1 or 2.

In formula [II], $X_2$ is preferably a group releasable upon coupling reaction with an oxidation product of an aromatic primary amide developing agent (hereinafter referred to as "releasable group"). Specific examples of a releasable groups include halogen atoms (e.g., fluorine, chlorine, bromine, iodine), $C_{1-24}$ heterocyclic group which is connected to the coupling active position via nitrogen atom, $C_{6-24}$ aryloxy group, $C_{6-24}$ arylthio group (e.g., phenylthio, p-t-butylphenylthio, p-chlorophenylthio, p-carboxyphenylthio), $C_{1-24}$ acyloxy group (e.g., acetoxy, benzoyloxy, dodecanoyloxy), $C_{1-24}$ alkylsulfonyloxy group (e.g., methylsulfonyloxy, butylsulfonyloxy, dodecylsulfonyloxy), $C_{6-24}$ arylsulfonyloxy group (e.g., benzenesulfonyloxy, p-chlorophenylsulfonyloxy), and $c_{1-24}$ heterocyclic oxy group (e.g., 3-pyridyloxy, 1-phenyl-1,2,3,4-tetrazol-5-yloxy). More preferably, $X_2$ is a heterocyclic group which is connected to the coupling active position via nitrogen atom, or aryloxy group.

If $X_2$ is a heterocyclic group which is connected to the coupling active position via a nitrogen atom, it is a 5- to 7-membered monocyclic or condensed heterocyclic which may contain herero atoms selected from oxygen, sulfur, nitrogen, phosphurus, selenium and tellurium other than nitrogen atom and may be substituted. Examples of such a hererocyclic group include succinimide, maleinimide, phthalimide, diglycolimide, pyrrole, pyrazole, imidazole, 1,2,4-triazole, tetrazole, indole, benzopyrazole, benzimidazole, benzotriazole, imidazolidin-2,4-dione, imidazolidin-2-one, oxazolin-2pone, thiaxzolin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabanic acid, 1,2,4-triazolidin-3,5-dione, 2-pyridone, 4-pyridone, 2-pyrimidone, 6-pyridazone, and 2-pyrazone. These heterocyclic groups may be substituted. Examples of substituents include hydroxyl group, carboxyl group, sulfo group, amino group (e.g., amino, N-methylamino, N,N-dimethylamino, N,N-diethylamino, anilino, pyrrolidino, piperidino, pyrrolidino, piperidino, morpholino), and substituents as set forth with reference to $R_3$.

If $X_2$ is an aryloxy group, it may be a $C_{6-24}$ aryloxy group. If $X_2$ is a heterocyclic group, it may be substituted by substituents selected from the group of substituents as set forth above. Preferred examples of such substituents include carboxyl group, sulfo group, cyano group, nitro group, alkoxycarbonyl group, halogen atom, carbonamide group, sulfonamide group, carbamoyl group, sulfamoyl group, alkyl group, alkylsulfonyl group, arylsulfonyl group, and acyl group.

With reference to the above mentioned substituents $R_1$, $R_2$, $R_3$ and $X_2$, examples of substituents which are particularly preferred are as follows.

In formula [II], $R_1$ is a 2- or 4-alkoxyaryl group (e.g., 4-methoxyphenyl, 4-butoxyphenyl, 2-methoxyphenyl) or t-butyl group, most preferably t-butyl group.

In formula [II], $R_2$ is a methyl group, ethyl group, alkoxy group, aryloxy group or dialkylamino group, most preferably methyl group, ethyl group, alkoxy group, aryloxy group or dimethylamino group.

In formula [II], $R_3$ is an alkoxy group, carbonamide group or sulfonamide group.

In formula [II], $X_2$ is a heterocyclic group which is connected to the coupling active position via a nitrogen atom or an aryloxy group.

If $X_2$ is a heterocyclic group as described above, it may be preferably represented by formula [III]:

[III]

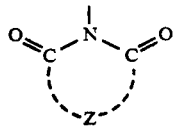

wherein Z represents —O—C($R_4$)($R_5$)—, —S—C($R_4$)($R_5$)—, —N($R_6$)—C($R_4$)($R_5$)—, —N($R_6$)—N($R_7$)—, —N($R_6$)—C(=0)—, —C($R_4$)($R_5$)—C($R_8$)($R_9$)— or —C($R_{10}$)=C($R_{11}$)— (in which $R_4$, $R_5$, $R_8$ and $R_9$ each represents a hydrogen atom, alkyl group, aryl group, alkoxy group, aryloxy group, alkylthio group, arylthio group, alkylsulfonyl group, arylsulfonyl group or amino group, $R_6$ and $R_7$ each represents a hydrogen atom, alkyl group, aryl group, alkylsulfonyl group, arylsulfonyl group or alkoxycarbonyl group, and $R_{10}$ and $R_{11}$ each represents a hydrogen atom, alkyl group or aryl group). $R_{10}$ and $R_{11}$ may be connected to each other to form a benzene ring. $R_4$ and $R_5$, $R_5$ and $R_6$, $R_6$ and $R_7$ or $R_4$ and $R_8$ may be connected to each other to form a ring (e.g., cyclobutane, cyclohexane, cycloheptane, cyclohexene, pyrrolidine, piperidine).

Particularly preferred among the heterocyclic groups represented by formula [III] are those represented by formula [III] wherein Z is a heterocyclic group represented by —O—C($R_4$)($R_5$)—, —N($R_6$)—C($R_4$)($R_5$)— or —N($R_6$)—N($R_7$)—.

The total number of carbon atoms to be contained in the heterocyclic group represented by formula [III] is in the range of 2 to 24, preferably 4 to 20, more preferably 5 to 16. Examples of the heterocyclic group represented by formula [III]include succinimide group, maleinimide group, phthalimide group, 1-methylimidazolidine-2,4-dion-3-yl group, 1-benzylimidazolidine-2,4-dion-3-yl group, 5,5-dimethyloxazolidiline-2,4-dion-3-yl group, 5-methyl-5-propyloxazolidine-2,4-dion-3-yl group, 5,5-dimethylthiazolidine-2,4-dion-3-yl group, 5,5-dimethylimidazolidine-2,4-dion-3-yl group, 3-methylimidazolidintrion-1-yl group, 1,2,4-triazolidin-3,5-dion-4-yl group, 1-methyl-2-phenyl-1,2,4-triazolidin-3,5-dion-4-yl group, 1-benzyl-2-phenyl-1,2,4-triazolidin-3,5-dion-4-yl group, 5-hexyloxy-1-methylimidazolidin-2,4-dion-3-yl group, and 1-benzyl-5-dodecyloxyimidazolidin-2,4-dion-3-yl group.

Most preferred among these heterocyclic groups is imidazolidin-2,4-dion-3-yl group (e.g., 1-benzylimidazolidin-2,4-dion-3-yl).

Most preferred examples of the aryloxy group methylsulfonylphenoxy group, 4-(4-benzyloxyphenylsulfonyl)phenoxy group, 4-(4-hydroxyphenylsulfonyl)-phenoxy group, 2-chloro-4-(3-chloro-4-hydroxyphenylsulfonyl)phenoxy group, 4-methoxycarbonylphenoxy group, 2-chloro-4-methoxycarbonylphenoxy group, 2-acetamido-4-methoxycarbonylphenoxy group, 4-isopropoxycarbonylphenoxy group, 4-cyanophenoxy group, 2-(N-(2-hydroxyethyl)carbamoyl)phenoxy group, 4-nitrophenoxy group, 2,5-dichlorophenoxy group, 2,3,5-trichlorophenoxy group, 4-methoxycarbonyl-2-methoxyphenoxy group, and 4-(3-carboxypropanamido)phenoxy group.

The coupler represented by formula [II] may be such that a dimer or higher polymer containing linking groups having a valence of two or more is formed in the substituents $R_1$, $X_2$ or

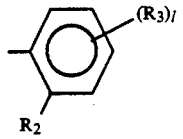

In this case, the total number of carbon atoms contained in the substituent may deviate from the above specified range.

If the coupler represented by formula [II] forms a polymer, a typical example of the polymer is a single polymer or copolymer of addition- polymerizable ethylenically unsaturated compound (yellow- coloring monomer) containing a yellow dye-forming coupler residue. In this case, the polymer may contain one or more yellow-coloring repeating units represented by formula [IV] and one or more non-coloring ethylenically unsaturated monomers as copolymerizable components.

[IV]

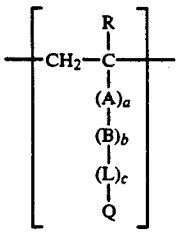

wherein R represents a hydrogen atom, $C_{1-4}$ alkyl group or chlorine atom; A represents —CONH—, —COO— or substituted or unsubstituted phenylene group; B represents a substituted or unsubstituted alkylene group, phenylene group or aralkylene group; L represents —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b, and c each represents 0 or 1; and Q represents a yellow coupler residue produced by separation of a hydrogen atom from $R_1$, $X_2$ or

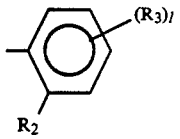

represented by formula [II].

The polymer is preferably a copolymer of a yellow-coloring monomer represented by formula [IV] and a non-coloring ethylenically unsaturated monomer as set forth below.

Examples of the non-coloring ethylenically unsaturated monomer which doesn't undergo coupling reaction with an oxidation product of an aromatic primary amine developing agent include acrylic acid, α-chloroacrylic acid, α-alkylacrylic acid (e.g., methacrylic acid), amide or ester derived from these acrylic acids (e.g., acrylamide, methacrylamide, n-butylacrylamide, t-butylacrylamide, diacetonacrylamide, methyl acrylate, ethyl acrylate, n-propyl acrylate, n-butyl acrylate, t-butyl acrylate, iso-butyl acrylate, 2-ethylhexyl acrylate, n-octyl acrylate, lauryl acrylate, methyl methacrylate, ethyl methacrylate, n-butyl methacrylate, 8-hydroxy methacrylate), vinyl ester (e.g., vinyl acetate, vinyl propionate, vinyl laurate), acrylonitrile, methacrylonitrile, aromatic vinyl compound (e.g., styrene and derivatives thereof, such as vinyl toluene, divinyl benzene, vinyl acetophenone and sulfostyrene), itaconic acid, citraconic acid, crotonic acid, vinylidene chloride, vinyl alkyl ether (e.g., vinyl ethyl ether), ester maleate, N-vinyl-2-pyrrolidone, N-vinyl pyridine, and 2- and 4-vinylpyridine.

Particularly preferred among these non-coloring ethylenically unsaturated monomers are acrylate ester, methacrylate ester, and maleate ester. Two or more of these non-coloring ethylenically unsaturated monomers may be used in combination. Examples of such a combination include a combination of methyl acrylate and butyl acrylate, a combination of butyl acrylate and styrene, a combination of butyl methacrylate and methacrylic acid, and a combination of methyl acrylate and diacetone acrylamide.

As is known in the field of polymer color couplers, the ethylenically unsaturated monomers to be copolymerized with a vinyl monomer corresponding to the general formula [IV] can be selected such that the physical and/or chemical properties, e.g., solubility, compatibility with a binder for photographic colloidal composition such as gelatin, flexibility and thermal stability, of the copolymer thus formed are favorably affected.

The preparation of the yellow polymer coupler to be used in the present invention can be accomplished by dissolving in an organic solvent a hydrophilic polymer coupler obtained by the polymerization of vinyl monomers which give coupler units represented by formula [IV], and then emulsion-dispersing the solution in an aqueous solution of gelatin in the form of latex, or by a direct emulsion polymerization process.

The emulsion dispersion of the hydrophilic polymer coupler in the aqueous solution of gelatin can be accomplished by any suitable method as described in U.S. Pat. No. 3,451,820. The emulsion polymerization of the vinyl monomers can be accomplished by any suitable method as described in U.S. Pat. Nos. 4,080,211 and 3,370,952.

Specific examples of substituents $R_3$ and $X_2$ in the yellow dye-forming coupler represented by formula [II] are set forth below, but the present invention should not be construed as being limited thereto.

Specific examples of $X_2$ include:

(1)

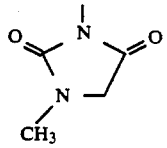

(2)

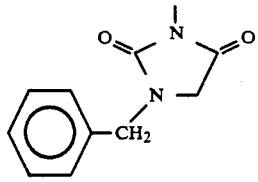

(3)

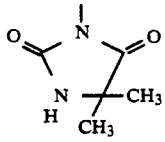

(4)

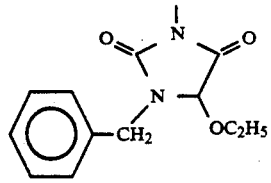

(5)

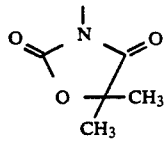

-continued
(6)
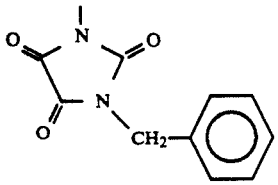
(7)
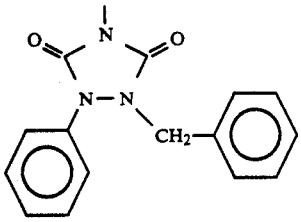
(8)
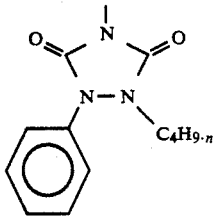
(9)
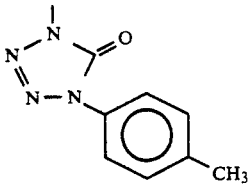
(10)
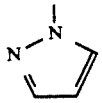
(11)
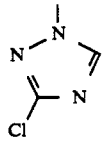
(12)
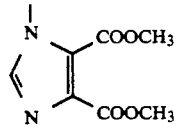
(13)
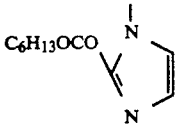
(14)
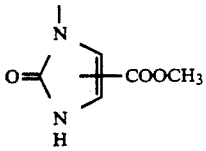
-continued
(15)
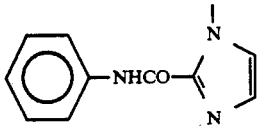
(16)
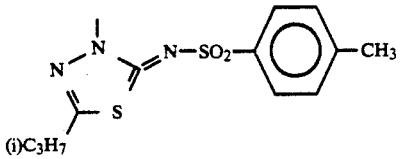
(17)
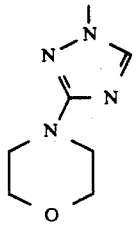
(18)
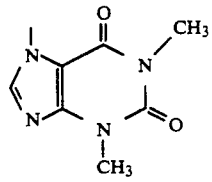
(19)
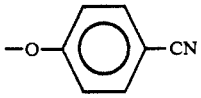
(20)
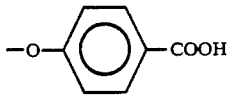
(21)
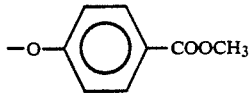
(22)
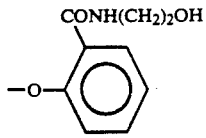
(23)
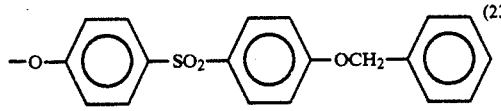
(24)
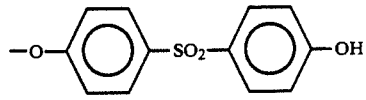

-continued (25)

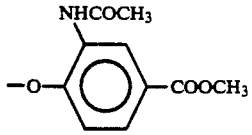

Specific exmaples of $R_3$ include:

$-NHCOC_{13}H_{27}(n)$ (30)

(31)

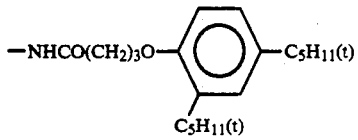

(32)

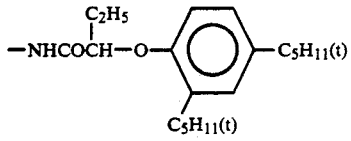

(33)

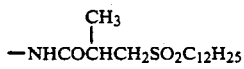

(34)

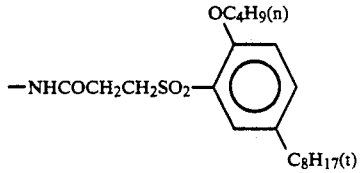

$-OC_{16}H_{33}(n)$ (35)

(36)

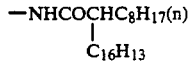

-continued (37)

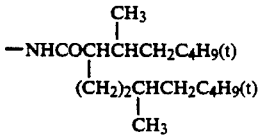

(38)

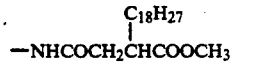

$-NHSO_2C_{12}H_{25}(n)$ (39)

$-NHSO_2C_{16}H_{33}(n)$ (40)

(41)

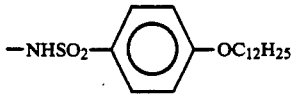

$-COOC_{12}H_{25}$ (42)

(43)

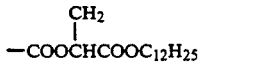

$-CONHC_{14}H_{29}$ (44)

$-OC_8N_{17}(n)$ (45)

(46)

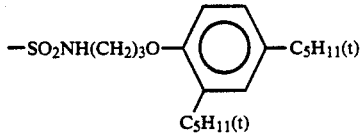

$-CONH(CH_2)_3OC_{12}H_{25}$ (47)

$-NHCOC_{15}H_{31}(n)$ (48)

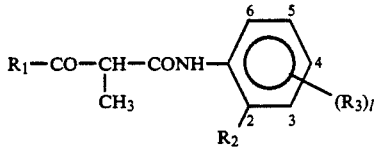

Specific exmaples of the yellow dye-forming coupler represented by formula [II] include:

| No. | $R_1$ | $R_2$ | $(R_3)_l$ | $X_2$ |
|---|---|---|---|---|
| Y-1 | $(t)C_4H_9-$ | $-OCH_3$ | (32)[5] | (4) |
| Y-2 | $(t)C_4H_9-$ | $-OCH_3$ | (32)[5] | (5) |
| Y-3 | $(t)C_4H_9-$ | $-CH_3$ | (31)[5] | (2) |
| Y-4 | $(t)C_4H_9-$ | 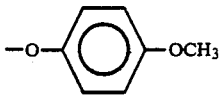 | (32)[5] | (5) |
| Y-5 | $(t)C_4H_9-$ | 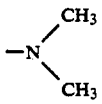 | (32)[5] | (4) |
| Y-6 | $(t)C_4H_9-$ | $-OCH_3$ | (33)[5] | (8) |
| Y-7 | $(t)C_4H_9-$ | $-OC_2H_5$ | (33)[5] | (7) |
| Y-8 | $(t)C_4H_9-$ | $-OCH_3$ | (38)[5] | (23) |
| Y-9 | $(t)C_4H_9-$ | 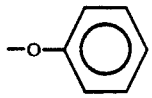 | (40)[5] | (19) |
| Y-10 | $(t)C_4H_9-$ | $-OC_8H_{17}(n)$ | (45)[4] | (5) |
| Y-11 | $(t)C_4H_9-$ | $-OC_8H_{17}(n)$ | (45)[5] | (5) |

-continued

| No. | $R_1$ | $R_2$ | $(R_3)_l$ | $X_2$ |
|---|---|---|---|---|
| Y-12 | (t)$C_4H_9$— | —$OCH_3$ | (42)[5] | (5) |
| Y-13 | (t)$C_4H_9$— | 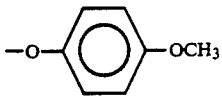 | (30)[5] | (10) |
| Y-14 | (t)$C_4H_9$— | —$OC_{16}H_{33}$(n) | — | (15) |
| Y-15 | (t)$C_4H_9$— | —$OCH_2CH_2OCH_3$ | (34)[5] | (8) |
| Y-16 | (t)$C_4H_9$— | —$CH_3$ | (43)[5] | (9) |
| Y-17 | (t)$C_4H_9$— | —$C_2H_5$ | (47)[5] | (8) |
| Y-18 | (t)$C_4H_9$— | —$OCH_3$ | (46)[5] | (2) |
| Y-19 | (t)$C_4H_9$— | —$OC_8H_{17}$(n) | (45)[4],(45)[5] | (5) |
| Y-20 | (t)$C_4H_9$— | —$OCH_3$ | (33)[5] | (19) |
| Y-21 | (t)$C_4H_9$— | 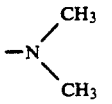 | (36)[4] | (18) |
| Y-22 | (t)$C_4H_9$— | 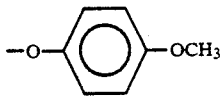 | (41)[5] | (11) |
| Y-23 | (t)$C_4H_9$— | 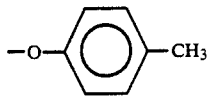 | (37)[5] | (3) |
| Y-24 | (t)$C_4H_9$— | —$OC_2H_5$ | (37)[5] | (1) |
| Y-25 | (t)$C_4H_9$— | —$CH_3$ | (38)[5] | (2) |
| Y-26 | (t)$C_4H_9$— | —$C_2H_5$ | (38)[5] | (2) |
| Y-27 | (t)$C_4H_9$— | —$CH_3$ | (33)[5] | (2) |
| Y-28 | 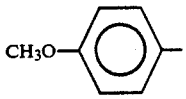 | —$OCH_3$ | (42)[5] | (4) |
| Y-29 | 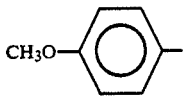 | 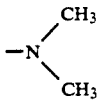 | (40)[5] | (4) |
| Y-30 | 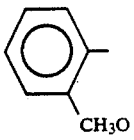 | —$CH_3$ | (43)[5] | (2) |

In the above table, the figure in the parenthesis ( ) indicates the number of the specific example of $X_2$ and $R_3$, and the figure in the parenthesis [ ] indicates the substitution position on the anilide group.

The couplers of the present invention may be used singly or in combination or in admixture with known yellow dye-forming couplers.

The couplers of the present invention may be incorporated in any layers, preferably light-sensitive silver halide emulsion layers or their adjacent layers, particularly light-sensitive silver halide emulsion layers in the light-sensitive material.

The synthesis of the couplers of the present invention can be accomplished by any known methods. Specific examples of such synthesis methods are described in JP-A-63-123047.

The amount of the yellow coupler to be incorporated in the light-sensitive material is in the range of $1.2\times10^{-3}$ to $10^{-2}$ mol, preferably $1.3\times10^{-3}$ to $5\times10^{-3}$ mol, more preferably $1.4\times10^{-3}$ to $3\times10^{-3}$ mol per $m^2$ of light-sensitive material.

The effects of the present invention can be more effectively attained when the above mentioned yellow coupler is near the support.

The weight ratio of the high boiling organic solvent in the same layer as that containing the yellow coupler to the yellow coupler is preferably in the range of 0.40 or less, more preferably 0 to 0.38 and the most preferably 0.2 to 0.38. However, it should be noted that no high boiling organic solvents need be incorporated into the system.

Known methods can be employed to incorporate the present cyan, magenta and yellow couplers in the light-sensitive layer or its adjacent layers. In general, a known oil-in-water dispersion process can be used as oil protect process to incorporate these color couplers in the light-sensitive layer or its adjacent layers. In particular, these color couplers may be emulsion-dispersed in an aqueous solution of gelatin in the form of solution in a solvent. Alternatively, water or an aqueous solution of gelatin may be added to a solution of the color coupler containing a surface active agent to cause phase inversion so that an oil-in-water dispersion is prepared. An alkali-soluble coupler can be dispersed by a so-called Fischer's dispersion process. A low boiling organic solvent may be removed from the coupler dispersion by distillation, noodle water-washing process or ultrafiltration process, and then the dispersion may be mixed with a photographic emulsion.

As dispersant for such a coupler, a high boiling organic solvent and/or water-insoluble high molecular compound having a dielectric constant (at 25° C.) of 2 to and a refractive index (at 25° C.) of 1.5 to 1.7 may be employed.

As the high boiling organic solvent there may be preferably used a high boiling organic solvent represented by one of formulae (A) to (E):

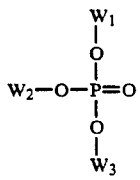
(A)

$W_1-COO-W_2$ (B)

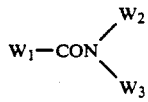
(C)

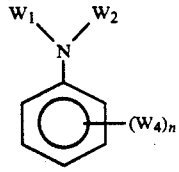
(D)

$W_1-O-W_2$ (E)

wherein $W_1$, $W_2$ and $W_3$ each represents a substituted or unsubstituted alkyl group, cycloalkyl group, alkenyl group, aryl group or heterocyclic group; $W_4$ represents $W_1$, $OW_1$ or $S-W_1$; and n represents an integer 1 to 5. When n is greater than 1, the plurality of $W_4$'s may be the same or different. In formula (E), $W_1$ and $W_2$ may together form a condensed ring.

In addition to those represented by formulae (A) to (E), any compound having a melting point of 100° C. or lower and a boiling point of 140° C. or higher which is scarcely miscible with water and can dissolve these couplers therein may be employed as the high boiling organic solvent. The melting point of such a high boiling organic solvent is preferably 80° C. or lower. The boiling point of the high boiling organic solvent is preferably 160° C. or higher, more preferably 170° C. or higher.

These high boiling organic solvents are further described in JP-A-62-215272, lower right column on page 137 - upper right column on page 144.

Furthermore, these couplers can be emulsion-dispersed in an aqueous solution of a hydrophilic colloid in the form of impregnation in a loadable latex polymer (as described in U.S. Pat. No. 4,203,716) or solution in a water-insoluble and organic solvent-soluble polymer in the presence or absence of the above mentioned high organic solvent.

Preferably, single polymers or copolymers as disclosed in U.S. Pat. No. 4,857,449, columns 7–15, and International Patent Disclosure W088/00723, pp. 12–30 may be used. In particular, methacrylate or acrylamide polymers may be preferably used in view of dye image stability.

The pH value of the raw paper constituting the support to be incorporated in the light-sensitive material of the present invention is in the range of 5 to 9, preferably 5.5 to 8.5.

In the present invention, the pH value of the raw paper can be determined by the hot water extraction process as specified in JIS-P-8133. The hot water extraction process as specified in JIS-P-8133 is as follows:

1.0 g of a specimen is weighed out. The specimen is then charged into a 100-ml conical flask. 20 ml of distilled water is added to the material. The specimen is dipped in water with the aid of a stirring rod having a flat tip until it is uniformly wet with water so that it is softened. 50 ml of distilled water is further added to the material. The material is further stirred. The flask is then equipped with a condenser. The flask is then put in a hot water bath such that the content of the flask is not boiled but is kept at a temperature of 95 to 100° C. The material is heated at this temperature range with often shaking for 1 hour. The material is then cooled to a temperature of 20° C.±5° C. The resulting extract is then measured for pH value by means of a glass electrode pH meter.

The details of the above mentioned measuring process and the instruments used in this process are according to Japanese Industrial Standard specified in 1963.

The structure of the paper support to be used in the present invention and specific means for adjusting the pH value of the raw paper to 5 to 9 will be described hereinafter.

The raw paper is prepared from wood pulp as main starting material. As wood pulp there may be used either needle-leaf tree pulp or broadleaf tree pulp. In the present invention, short fiber type broadleaf pulp may be preferably used in a large proportion. Specifically, broadleaf pulp preferably accounts for 60% or more by weight of the pulp constituting the base.

As necessary, the wood pulp may be partially replaced by a synthetic pulp made of polyethylene, polypropyrene or the like or synthetic fiber made of polyester, polyvinyl alcohol, nylon or the like.

The entire water leakage of the pulp used is preferably in the range of 150 to 500 cc, more preferably 200 to 400 cc as specified by Canadian Standard Freeness (CSF). The fiber length of the pulp which has been beated is preferably adjusted such that the residue on 24+42 mesh specified in JIS-P-8207 reaches 40% by weight or less.

A sizing agent is normally incorporated in the raw paper. In the present invention, since the pH value of the raw paper needs to be adjusted to 5 to 9, a neutral sizing agent such as epoxy aliphatic amide, anhydrous aliphatic acid, anhydrous resin acid, alkenyl succinate anhydride, amide succinate, isopropenyl stearate, aziridine compound and alkyl ketene dimer is preferably used.

A fixing agent for the sizing agent is normally incorporated in the raw paper. In the present invention, since the pH value of the raw paper needs to be adjusted to 5 to 9, an aluminum sulfate commonly used as fixing agent is preferably replaced by a neutral or weakly alkaline compound such as cationic starch, polyamido-polyamine epichlorohydrin, polyacrylamide and polyacrylamide derivative. Alternatively, the aluminum sulfate may be incorporated in the raw paper, and the base may be then neutralized with an alkali.

For the purpose of improving the smoothness of the paper support, a filler such as calcium carbonate, talc, clay, kaolin, titanium dioxide and particulate urea resin may be incorporated in the raw paper.

Chemicals other than sizing agent, fixing agent and filler may be optionally incorporated in the raw paper. Such chemicals include a paper strength improver such as polyacrylamide, starch and polyvinyl alcohol, a flexibilizer such as reaction product of maleic anhydride copolymer and polyalkylene polyamine and quaternary ammonium salt of higher aliphatic acid, a colored dye, a fluorescent dye or the like. These chemicals are preferably selected such that their pH value is almost neutral because the pH value of the base needs to be adjusted to 5 to 9. If acidic or alkaline chemicals need to be used, they are preferably used in as small an amount as possible.

As the raw paper constituting support there can be used any of the above mentioned materials. The paper support can be prepared from such a raw paper by means of a wire paper machine or cyclinder paper machine.

The weight of the raw paper is preferably in the range of 20 to 300 g/m$^2$, particularly 50 to 200 g/m$^2$ The thickness of the raw paper is preferably in the range of 25 to 350 μm, particularly 40 to 250 μm.

For the purpose of improving the smoothness of the paper support, the raw paper is subjected to on-machine calendering during paper making or supercalendering after paper making. The raw paper thus calendered preferably exhibits a density of 0.7 to 1.2 g/m$^2$, particularly 0.85 to 1.10 g/m$^2$ as specified by JIS-P-8118.

By using the above mentioned paper making process, particularly by selecting the above mentioned chemicals (e.g., sizing agent, fixing agent) and a surface sizing agent, the pH value of the raw paper thus prepared can be adjusted to 5 to 9.

In the light-sensitive material of the present invention, the above mentioned raw paper can be used as paper support as it is. Alternatively, a surface sizing agent may be coated on the surface of the raw paper. Examples of surface sizing agents include polyvinyl alcohol, starch, polyacrylamide, gelatin, casein, styrene-maleic anhydride copolymer, alkyl ketene dimer, polyurethane, and epoxy aliphatic amide.

A coat layer may also be provided on either or both sides of the raw paper (including those having a surface sizing agent coated thereon). The structure of the above mentioned coat layer is not specifically limited. The above mentioned coat layer preferably comprises a hydrophobic polymer. The use of a hydrophobic polymer enables a reduction in the water absorption, minimizing the deflection of the support upon the coating of the light-sensitive layer.

The above mentioned hydrophobic polymer may be a homopolymer or copolymer. In the case of such a copolymer, even if it contains some hydrophilic repeating units, any copolymer which is hydrophobic as a whole may be used. Examples of hydrophobic polymers include polyethylene, polypropylene, vinylidene chloride, styrene-butadiene copolymer, methyl methacrylate-butadiene copolymer, acrylonitrilebutadiene copolymer, styrene-acrylic ester copolymer, methyl methacrylate-acrylic ester copolymer, and styrene-methacrylate-acrylic ester copolymer.

For the purpose of improving the resolving power, a pigment may be incorporated in the coat layer. Such pigments include those recognized in the art as being incorporated into known coated papers. Examples of such a pigment include inorganic pigments such as titanium dioxide, barium sulfate, talc, clay, kaolin, calcinated kaolin, aluminum hydroxide, amorphous silica, crystalline silica and synthetic alumina silica, and organic pigments such as polystyrene resin, acrylic resin and urea formalin resin.

The amount of the pigment to be incorporated in the hydrophobic polymer is preferably in the range of 5 to 60% by weight, more preferably 8 to 30% by weight, particularly 14 to 30% by weight.

Examples of process by which the above mentioned coat layer can be coated include extrusion coating process, dip coating process, air knife coating process, curtain coating process, roller coating process, doctor coating process, and gravure coating process.

If the above mentioned coat layer is provided, the amount of the material to be coated on the base is preferably in the range of 1 to 100 g/m$^2$, more preferably 5 to 60 g/m$^2$.

For the purpose of improving the smoothness of the paper support, the material is preferably subjected to calendering such as gloss calendering and supercalendering during or after the coating of the above mentioned coat layer.

The magenta coupler represented by formula (I) preferably exhibits a relative coupling rate of 0.1 to 1.0.

In the present invention, the relative coupling rate is represented by X:

$$X = \frac{1}{\frac{\tan A}{\tan B} - 1}$$

For the measurement, the following single-layer coat specimen is developed with Color Developers A and B, respectively, to determine the relationship between $Ag^0$ and Dye (Dye/$Ag^0$), wherein $Ag^0$ is the amount of developed silver; and Dye is the amount of dye. The slope of the linear line portion of Dye/$Ag^0$ curve developed with Color Developer A is tanA while that developed with Color Developer B is tanB.

| Single-layer coat specimen | |
|---|---|
| Support: Polyethylene terephthalate | |
| 1st layer: | |
| Silver bromochloride (silver bromide: 70 mol %) | 8 mmol/m$^2$ as silver |
| Coupler | 1 mmol/m$^2$ |
| Trioctyl phosphate (1:1 by weight based on coupler) | |
| Gelatin | 4 g/m$^2$ |
| Film hardener (sodium salt of 1-oxy-3,5-dichloro-s-triazine) | 3.2 mg/m$^2$ |
| 2nd layer: | |
| Gelatin | 1 g/m$^2$ |
| Film hardener (same as above) | 0.8 mg/m$^2$ |
| Color developer: | |

-continued

| Single-layer coat specimen | | |
|---|---|---|
| | A | B |
| Water | 800 ml | 800 ml |
| Potassium bromide | 0.6 g | 0.6 g |
| Sodium hydrogencarbonate | 0.7 g | 0.7 g |
| Potassium carbonate | 31.7 g | 31.7 g |
| Sodium sulfite | 0.3 g | 0.3 g |
| N-ethyl-N-(β-methanesulfonamideethyl)-3-methyl-4-aminoaniline sulfate | 4.5 g | 4.5 g |
| Citrazinic acid | — | $1 \times 10^{-3}$ mol |
| Water to make | 1,000 l | 1,000 l |
| pH (25° C.) | 10.25 | 10.25 |
| Stop solution: | | |
| 1 wt % aqueous solution of acetic acid | | |

As bleaching solution and fixing solution there may be used those commercially available. For example, bleaching solution N-3 comprising a color negative film processing agent CN-16 and fixing solution N3 (trade name, available from Fuji Photo Film Co., Ltd.) can be used for evaluation.

| Processing step |
|---|
| Color developer (33° C., 3 min. 30 sec.) |
| ↓ |
| Stop solution (33° C., 1 min.) |
| ↓ |
| Fixing solution (33° C., 5 min.) |
| ↓ |
| Water washing (25° C.–35° C., 3 min.) |
| ↓ |
| Drying |
| ↓ |
| Measurement of amount of silver |
| ↓ |
| Bleaching bath |
| ↓ |
| Fixing bath |
| ↓ |
| Water washing |
| ↓ |
| Drying |
| ↓ |
| Measurement of density (densitometer FCD-103, available from Fuji Photo Film Co., Ltd.) |

The color photographic light-sensitive material of the present invention can comprise, on a support, at least each one of blue-sensitive silver halide emulsion layer, green-sensitive silver halide emulsion layer and red-sensitive silver halide emulsion layer. In a normal color photographic paper, the order of arrangement of these emulsion layers is as described above. However, the order of arrangement of these layers may be altered from that described above. In another embodiment, an infrared light-sensitive silver halide emulsion layer may replace at least one of these emulsion layers. These light-sensitive emulsion layers can comprise silver halide emulsions sensitive to the respective wavelength ranges and so-called color couplers which form dyes complementary to the light to which they are sensitive, i.e., yellow for blue, magenta for green and cyan for red, so that a subtractive color reproduction can be effected. However, these light-sensitive layers and color hues developed from these couples may not necessarily have the above mentioned correspondence.

The silver halide emulsion preferably employed in the present invention is a silver halide emulsion comprising silver bromochloride substantially free of silver iodide or comprising silver chloride. The term "silver bromochloride substantially free of silver iodide" as used herein means "silver bromochloride having a silver iodide content of 1 mol. % or less, preferably 0.2 mol. % or less". The halogen composition of the emulsion may be the same or different from grain to grain. If an emulsion having the same halogen composition from grain to grain is used, the properties of the grains can easily be made uniform. The halogen composition in the silver halide emulsion grain can be properly selected from so-called uniform type grain wherein the composition is uniform in any portion, so-called lamination type grain wherein the halogen composition differs from core to shell (single layer or plural layers) and grain having a non-layered internal or surface portion differing from the other portion in halogen composition (if this portion lies in the surface of the grain, a portion with a different halogen composition may be fused to the edges, corners or faces of the gain). In order to obtain a high sensitivity, the latter two types of grains may be advantageously used rather than the uniform type of grain. These two types of grains are also preferable in terms of pressure resistance. If the silver halide grain has the above mentioned structure, the interface of the different halogen compositions may be a definite interface, an indefinite interface containing a mixed crystal formed by composition difference, or a portion having a positively continuous structure change.

These silver bromochloride emulsions may have a halogen composition having any ratio of silver bromide/silver chloride. This ratio can be widely selected depending on the purpose. The ratio of silver chloride is preferably 2% or more.

The light-sensitive material suitable for rapid processing preferably employed is a so-called high silver chloride emulsion having a high silver chloride content. The silver chloride content of such a high silver chloride emulsion is preferably 90 mol. %, more preferably 95 mol. % or more.

In such a high silver chloride emulsion, a silver bromide localized phase lies preferably in layers or other structures in and/or on silver halide grains. In the halogen composition of the above mentioned localized phase, the silver bromide content is preferably at least 10 mol. %, more preferably more than 20 mol. %. The localized phase may lie inside the grain or on the edges, corners or faces of the grain. In a preferred example, such a localized phase is formed on the corners of the grain by epitaxial growth.

On the other hand, for the purpose of minimizing the drop in the sensitivity of the light-sensitive material under pressure, a high silver chloride emulsion having a silver chloride content of 90 mol. % or more also may preferably comprise uniform grains having a small halogen composition distribution therein.

Furthermore, for the purpose of reducing the replenishment rate of the developer, it is effective to further increase the silver chloride content of the silver halide emulsion. In this case, a substantially pure silver chloride emulsion having a silver chloride content of 98 to 100 mol. % may be preferably used.

The average grain size (number average of the diameter of circles equivalent to the projected area of grains) of silver halide grains contained in the silver halide emulsion to be used in the present invention is preferably in the range of 0.1 to 2 μm.

The grain size distribution is preferably monodisperse such that the fluctuation coefficient thereof (obtained by dividing the standard deviation of the grain size distribution by the average grain size) is 20% or less, preferably 15% or less. For the purpose of obtaining a wide latitude, a blend of such monodisperse emulsions may be preferably incorporated in the same layer or such monodisperse emulsions may preferably be separately coated in layers.

The silver halide grains to be incorporated in the photographic emulsion may have a regular crystal form such as cube, tetradecahedron and octahedron, irregular crystal form such as sphere and tablet or composite thereof. Alternatively, the present silver halide grains may comprise a mixture of grains having various crystal forms. In the present invention, the silver halide grains preferably comprise grains having the above mentioned regular crystal form in a proportion of 50% or more, preferably 70% or more, more preferably 90% or more.

Moreover, an emulsion wherein tabular grains having an aspect ratio (diameter as calculated in terms of circle/thickness) of 5 or more, preferably 8 or more, account for more than 50% of all grains, as calculated in terms of projected area, is also be preferably used.

The preparation of the silver bromide emulsion which can be used in the present invention can be accomplished by any suitable method as described in P. Glafkides, "Chimie et Physique Photographique", Paul Montel (1967), G.F. Duffin, "Photographic Emulsion Chemistry", Focal Press, 1966, and V.L. Zelikman et al., "Making and Coating Photographic Emulsion", Focal Press, 1964. In some detail, the emulsion can be prepared by any of the acid process, the neutral process, the ammonia process, etc. The reaction between a soluble silver salt and a soluble halogen salt can be carried out by any of a single jet process, a double jet process, a combination thereof, and the like. A method in which grains are formed in the presence of excess silver ions (so-called reverse mixing method) may be used. Further, a so-called controlled double jet process, in which a pAg value of a liquid phase in which silver halide grains are formed is maintained constant, may also be used. According to the controlled double jet process, a silver halide emulsion having a regular crystal form and an almost uniform grain size can be obtained.

During the formation or the physical ripening of the silver halide emulsion grains, various multivalent metal ion impurities can be incorporated in the system. Examples of such compounds include salts of cadmium, zinc, lead, copper and thallium, and salts or complex salts of the group VIII elements, e.g., iron, ruthenium, rhodium, palladium, osmium, iridium and platinum. In particular, the above mentioned group VIII elements may be preferably used. The amount of these compounds to be incorporated can be widely selected depending on the purpose of application and is preferably in the range of $10^{-9}$ to $10^{-2}$ mol per mol of silver halide.

The silver halide emulsion to be used in the present invention is normally subjected to chemical or spectral sensitization.

The chemical sensitization can be accomplished by sulfur sensitization with, e.g., an instable sulfur compound, noble metal sensitization such as gold sensitization, and reduction sensitization, singly or in combination. The compounds preferably employed in the chemical sensitization are those described JP-A-62-15272, lower right column on page 18 —upper right column on page 22.

The spectral sensitization is effected for the purpose of providing the emulsion in each layer in the present light-sensitive material with a spectral sensitivity in a desired light wavelength range. In the present invention, this spectral sensitization is preferably carried out by incorporating in the system a dye which absorbs light having a wavelength range corresponding to the desired spectral sensitivity, i.e., spectral sensitizing dye. Examples of such a spectral sensitizing dye include those described in F. M. Harmer, "Heterocyclic Compounds—Cyanine Dyes and Related Compounds", John Wiley & Sons (New York, London), 1964. Specific examples of such compounds and spectral sensitizing processes which can be preferably used in the present invention are described in the above cited JP-A-62-215272, upper right column on page 22 to page 38.

For the purpose of inhibiting fogging during the preparation, storage or photographic processing of the light-sensitive material or stabilizing the photographic properties of the light-sensitive material, various compounds or precursors thereof can be incorporated in the silver halide emulsion. Specific examples of compounds which are preferably used in the present invention are described in the above cited JP-A-62-215272, pp. 39–72.

The emulsion to be used in the present invention may be either of the so-called surface latent image type in which latent images are formed mainly on the surface of grains or of the so-called inner latent image type in which latent images are formed mainly inside grains. The color light-sensitive material normally comprises yellow, magenta and cyan couplers which undergo coupling reaction with an oxidation product of an aromatic amine developing agent to color yellow, magenta and cyan, respectively.

The cyan couplers which can be preferably used in the present invention are represented by formulae (C-I) and (C-II):

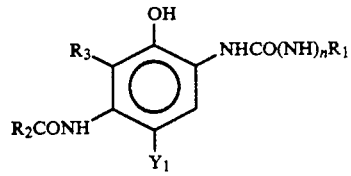

(C-I)

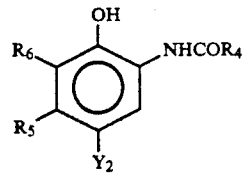

(C-II)

In formulae (C-I) and (C-II), $R_1$, $R_2$ and $R_4$ each represents a substituted or unsubstituted aliphatic, aromatic or heterocyclic group. $R_3$, $R_5$ and $R_6$ each represents a hydrogen atom, halogen atom, aliphatic group, aromatic group or acylamino group. $R_3$ may represent an atomic group which forms a 5- or 6-membered nitrogen-containing ring with $R_2$. $Y_1$ and $Y_2$ each represents a hydrogen atom or a group releasable upon coupling reaction with an oxidation product of a developing agent. The suffix n represents an integer 0 or 1.

In formula (C-II), $R_5$ is preferably an aliphatic group. Examples of such an aliphatic group include methyl, ethyl, propyl, butyl, pentadecyl, tert-butyl, cyclohexyl, cyclohexylmethyl, phenylthiomethyl, dodecyloxyphenylthiomethyl, butanamidemethyl, and methylmethyl.

Preferred examples of the cyan coupler represented by formula (C-I) or (C-II) are set forth below.

In formula (C-I), $R_1$ is preferably an aryl group or heterocyclic group, more preferably halogen atom, alkyl group, alkoxy group, aryloxy group, acylamino group, acyl group, carbamoyl group, sulfonamide group, sulfamoyl group, sulfonyl group, sulfamide group, oxycarbonyl group or aryl group substituted by cyano group.

In formula (C-I), if $R_3$ and $R_2$ do not form a ring, $R_2$ is preferably a substituted or unsubstituted alkyl or aryl group, particularly substituted aryloxy-substituted alkyl group, and $R_3$ is preferably a hydrogen atom.

In formula (C-II), $R_4$ is preferably a substituted or unsubstituted alkyl or aryl group, particularly substituted aryloxy-substituted alkyl group.

In formula (C-II), $R_5$ is preferably a $C_{2-15}$ alkyl group or methyl group containing a substituent having one or more carbon atoms. Preferred examples of such substituents include arylthio group, alkylthio group, acylamino group, aryloxy group, and alkyloxy group.

In formula (C-II), $R_5$ is more preferably a $C_{2-15}$ alkyl group, particularly $C_{2-4}$ alkyl group.

In formula (C-II), $R_6$ is preferably a hydrogen atom or halogen atom, particularly chlorine atom or fluorine atom. In formulae (C-I) and (C-II), $Y_1$ and $Y_2$ are each preferably a hydrogen atom, halogen atom, alkoxy group, aryloxy group, acyloxy group or sulfonamide group.

Specific examples of couplers represented by formulae (C-I) and (C-II) are illustrated below:

(C-1)

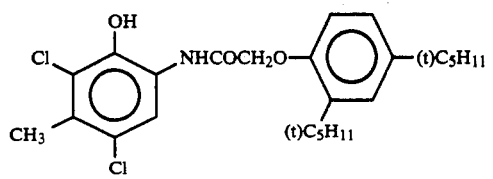

(C-2)

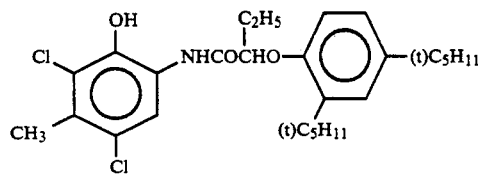

(C-3)

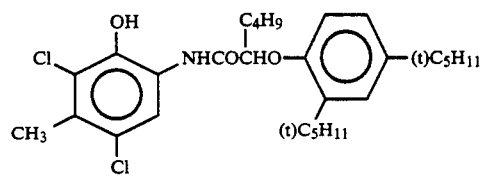

(C-4)

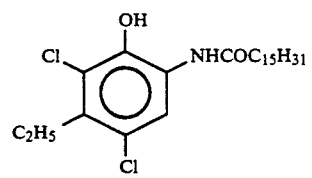

(C-5)

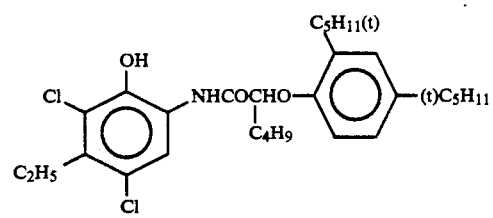

(C-6)

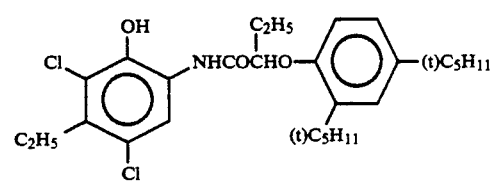

-continued
(C-7)
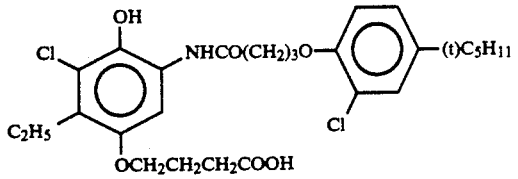
(C-8)
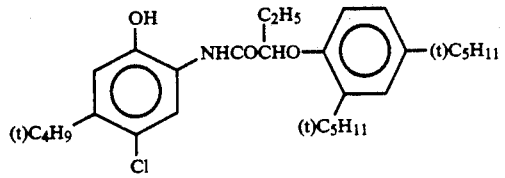
(C-9)
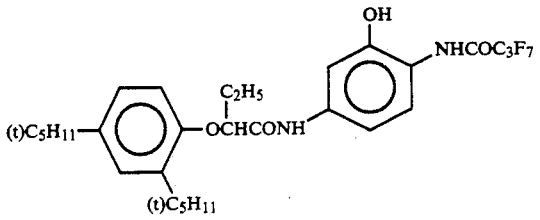
(C-10)
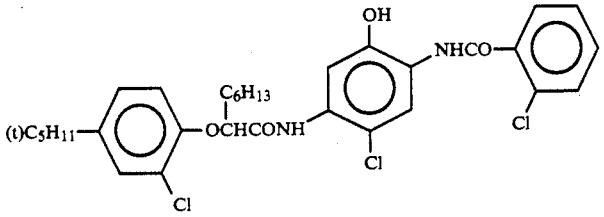
(C-11)
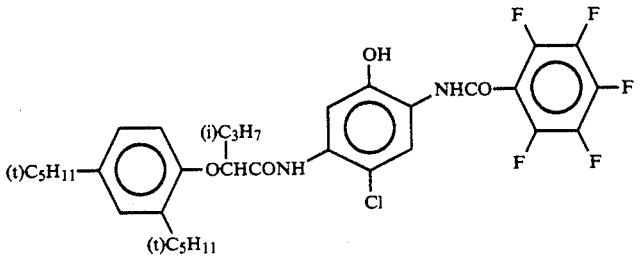
(C-12)
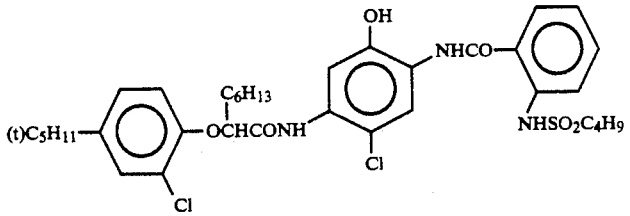
(C-13)
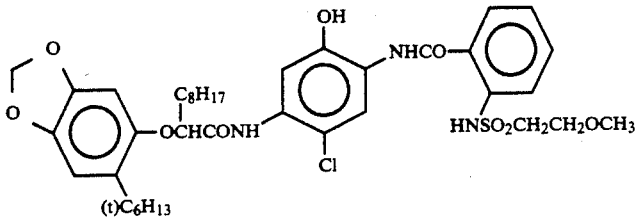

-continued
(C-14)
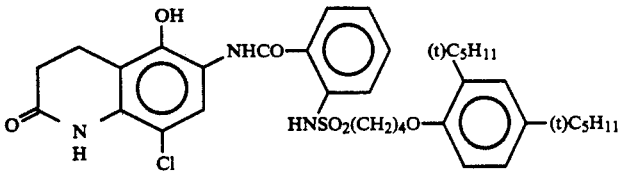
(C-15)
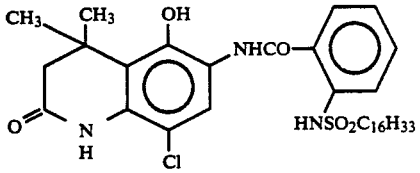
(C-16)
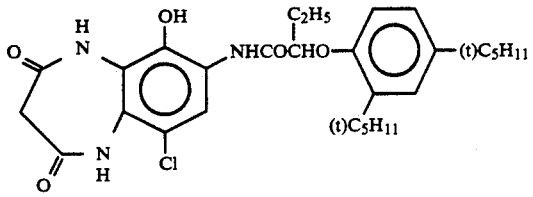
(C-17)
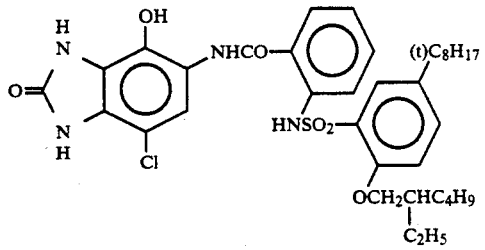
(C-18)
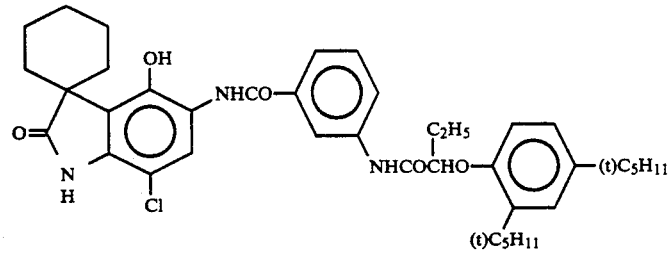
(C-19)
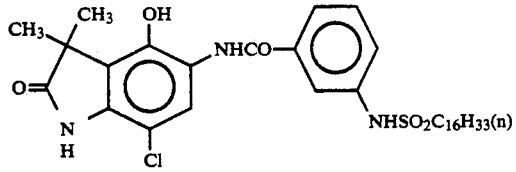
(C-20)
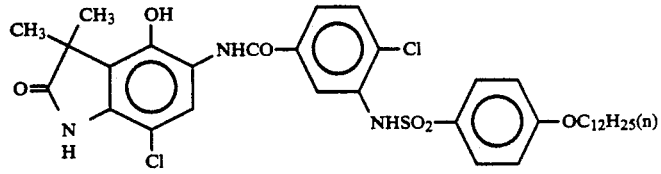

-continued (C-21)

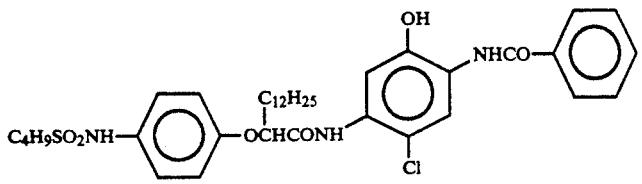

(C-22)

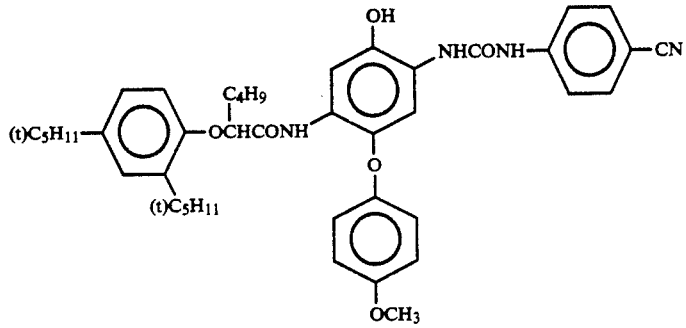

The couplers represented by formula (C-I) and (C-II) each may be incorporated in the silver halide emulsion layers constituting the light-sensitive layer in an amount of 0.1 to 1.0 mol, preferably 0.1 to 0.5 mol per mol of silver halide.

The light-sensitive material prepared according to the present invention may further comprise a color fogging inhibitor such as a hydroquinone derivative, aminophenole derivative, gallic acid derivative, ascorbic acid derivative or the like.

The light-sensitive material of the present invention can also comprise various discoloration inhibitors. Typical examples of organic discoloration inhibitors for cyan, magenta and/or yellow images include hydroquinones, 6-hydroxychromans, 5-hydroxycoumarans, spirochromans, p-alkoxyphenols, hindered phenols such as bisphenols, gallic acid derivatives, methylenedioxybenzenes, aminophenols, hindered amines, and ether or ester derivatives obtained by silylating or alkylating the phenolic hydroxyl group in these compounds. Metal complexes such as (bissalicylaldoximate)nickel complex and bis(N,N-dialkyldithicarbamate)nickel complex may also be used.

Specific examples of organic discoloration inhibitors are described in the following patents:

Specific examples of hydroquinones are described in U.S. Pat. Nos. 2,360,290, 2,418,613, 2,700,453, 2,701,197, 2,728,659, 2,732,300, 2,735,765, 3,982,944, 4,430,425, 2,710,801, and 2,816,028, and British Patent 1,363,921. Specific exmaples of 6-hydroxychromans, 5-hydroxycoumarans and spirochromans are described in U.S. Pat. Nos. 3,432,300, 3,573,050, 3,574,627, 3,698,909, and 3,764,337, and JP-A-52-152225. Specific exmaples of spiroindans are described in U.S. Pat. No. 4,360,589. Specific examples of p-alkoxyphenols are described in U.S. Pat. No. 2,735,765, British Patent 2,066,975, JP-A-59-10539, and JP-B-19765 (the term "JP-B" are used herein means an "examined Japanese patent publication"). Specific exmaples of hindered phenols are described in U.S. Pat. Nos. 3,700,455 and 4,228,235, JP-A-52-72224, and JP-B-52-6623. Specific examples of gallic acid derivatives, methylenedioxybenzenes, and aminophenols are described in U.S. Pat. Nos. 3,457,079, and 4,332,886, and JP-B-56-21144. Specific exmaples of hindered amines are described in U.S. Pat. Nos. 3,336,135, and 4,268,593, British Patents 1,326,889, 1,354,313, and 1,410,846, JP-B-51-1420, and JP-A-58-114036, 59-53846, and 59-78344. Specific examples of metal complexes are described in U.S. Pat. Nos. 4,050,938, and 4,241,155, and British Patent 2,027,731(A). These compounds can be incorporated in the light-sensitive material in the form of co-emulsion with the respective corresponding color coupler in an amount of 5 to 100% by weight based thereon to accomplish the objects of the present invention. In order to inhibit the deterioration of cyan dye images due to heat, particularly light, it is effective to incorporate an ultraviolet absorbent in the cyan color layer and its both adjacent layers.

As such an ultraviolet absorbent there may be used a benzotriazole compound substituted by aryl group (as described in U.S. Pat. No. 3,533,794), 4-thiazolidone compound (as described in U.S. Pat. Nos. 3,314,794, and 3,352,681), benzophenone compound (as described in JP-A-46-2784), cinnamate ester compound (as described in U.S. Pat. Nos. 3,705,805, and 3,707,395), butadiene compound (as described in U.S. Pat. No. 4,045,229) or benzoxadole compound (as described in U.S. Pat. Nos. 3,406,070, 3,677,672,a nd 4,271,3076). Alternatively, ultraviolet-absorbing couplers (e.g., α-naphtholic cyan dye-forming coupler) or ultraviolet-absorbing polymers can be used. The ultraviolet absobents may be mordanted in specific layers.

Particularly preferred among these ultraviolet absorbents are the above mentioned benzotriazole compounds substituted by aryl group.

The above mentioned couplers may be used in combination with the following compounds, particularly pyrazoloazole couplers.

In particular, a compound (F) which undergoes chemical bonding with an aromatic amine developing agent present after color development to produce a chemically inert and substantially colorless compound and/or a compound (G) which undergoes chemical bonding with an oxidation product of an aromatic amine developing agent present after color development to produce a chemically inert and substantially colorless compound ca be used at the same time with or separately of these couplers to inhibit stain and other side reactions due to the production of colored dyes caused by the reaction of these couplers with the color developing agent or oxidaztion product thereof left in the film during storage after processing.

The Compound (F) is preferably a compound which undergoes second order reaction with p-anisidine in trioctyl phosphate at a temperature of 80° C. at a rate $K_2$ of 1.0 l/mol.sec to $1\times10^{-5}$ l/mol.sec. The second order reaction rate can be determined by the method as described in JP-A-63-1585435.

If $k_2$ is greater than this range, the compound becomes unstable itself, reacting with gelatin or water to decompose itself. On the other hand, if $k_2$ is smaller than this range, the compound may react slowly with the residual aromatic amine developing agent, making it impossible to inhibit side reactions of the residual aromatic amine developing agent. Preferred examples of Compound (F) can be represented by formulae (FI) and (FII):

$$R_1-(A)_n-X \quad \text{(FI)}$$

$$R_2-C(B)=Y \quad \text{(FII)}$$

wherein $R_1$ and $R_2$ each represents an aliphatic group, aromatic group or heterocyclic group; n represents 0 or 1; A represents a group which reacts with an aromatic amine developing agent to form a chemical bond; X represents a group releasable upon reaction with an aromatic amine developing agent; B represents a hydrogen atom, aliphatic group, aromatic group, heterocyclic group, acyl group or sulfonyl group; and Y represents a group which accelerates the addition of an aromatic amine developing agent to the compound rearrested by formula (FII). $R_1$ and X, and Y and either $R_2$ or B may be connected to each other to form a cyclic structure.

Typical exmaples of the process by which A or B undergoes chemical bonding with the residual aromatic amine developing agent include substitution reaction and addition reaction.

Specific preferred examples of the compounds represented by formulae (FI) and (FII) include those described in JP-A-158545, and JP-A-62-283338, and European Patent Nos. 298321A, and 277589A.

Preferred examples of Compound (G) which undergoes chemical bonding with an oxidation product of an aromatic amine developing agent left after color development to produce a chemically inert and substantially colorless compound can be represented by formula (GI):

$$R-Z \quad \text{(GI)}$$

wherein R represents an aliphatic, aromatic or heterocyclic group; and Z represents a nucleophilic group or a group which decomposes in the light-sensitive material to release a nucleophilic group. The compound represented by formula (GI) is preferably a group having Pearson's nucleophilic $^nCH_3I$ value [R. G. pearson, "Journal of American Society", 90, 319 (1968)] of 5 or more or a group derived therefrom.

Specific preferred examples of the group represented by formula (GI) include those described in European Patent Nos. 255722A, 298321A, and 277589A, and JP-A-62-143048, JP-A-62-229145, JP-A-1-230030, and JP-A-1-57259.

The combination of Compound (G) and Compound (F) is further described in European Patent No. 277589A.

The light-sensitive material prepared according to the present invention may comprise a water-soluble dye or a dye which becomes water-soluble after photographic processing in the hydrophilic colloidal layer as filter layer or for the purpose of inhibiting irradiation or halation or other various purposes. Useful examples of such dyes include oxonol dye, hemioxonol dye, styryl dye, melocyanine dye, cyanine dye and azo dye. Particularly useful among these dyes are oxonol dye, hemioxonol dye and melocyanine dye.

As binders or protective colloids to be incorporated in the emulsion layer in the light-sensitive material of the present invention there can be advantageously used gelatin. Other hydrophilic colloids can be used singly or in combination with gelatin.

As gelatin to be used in the present invention there can be used lime-treated gelatin or acid-treated gelatin. The preparation of gelatin is further described in Arthur Vice, "The Macromolecular Chemistry of Gelatin", Academic Press, 1964.

The color light-sensitive material of the present invention may be exposed to visible light or infrared light. The exposure of the present light-sensitive material may be effected by low intensity exposure process or high intensity short time exposure process. In the latter case, a laser scanning exposure process may be preferably effected so that the exposure time per pixel is less than $10^{-4}$ second.

When the light-sensitive material of the present invention is exposed to light, a band stop filter as described in U.S. Pat. No. 4,880,726 may be preferably used. The use of such a band stop filter eliminates light color stain, enabling a remarkable improvement in color reproducibility.

The color light-sensitive material of the present invention which has been thus exposed may then be preferably processed with a color processing solution as described in Eurpean Patent 355660A2, page 67, line 14 to page 69, line 28.

In the interest of brevity and conciseness, the contents of the aforementioned numerous patents and articles are hereby incorporated by reference.

The present invention will be further described in the following examples, but the present invention should not be limited thereto.

Preparation of Paper Support

A wood pulp made of 70 parts of LBKP and 30 parts of LBSP was beaten to Canadian Standard Freeness (CSF) 290 cc by means of a disc refiner. As neutral sizing agents there were added to the system an alkyl ketene dimer (Acopel 12, available from Dickhercules), an anionic polyacrylamide (Polystron 194-7, available from Arakawa Kagaku Kogyo K.K.), a cationic polyacrylamide (Polystron 705, available from Arakawa Kagaku Kogyo K.K.), and a polyamide polyamine epichlorohydrin (Kaimen 557, available from Dickhercules) in amounts of 1.0 part, 1.0 part, 0.5 part, and 0.3 part by absolute dry weight based on pulp, respectively. The material was then subjected to paper making by means of a wire paper machine to prepare a base having a weight of 170 g/m$^2$ and a thickness of 165 μm as Base (A).

The pH value of Base (A) was measured by hot water extraction process as specified by JIS-P-8133. The result was 6.4.

As neutral sizing agents there were added to the same beaten pulp as used in Base (A) an epoxy aliphatic amide (NS-715, available from Kindai Kagaku Kogyo K.K.), anion polyacrylamide (Polystron 194-7, available from Arakawa Kagaku Kogyo K.K.), aluminum sulfate, NaOH, and cationic starch in amounts of 0.6 parts, 1.2 parts, 1.0 part, 0.9 parts, and 1.0 part by absolute dry weight based on pulp, respectively.

The material was then subjected to paper making in the same manner as in raw paper (A) to prepare a raw paper having a weight of 170 g/m$^2$ and a thickness of 165 μm as raw paper (B). The pH value of raw paper (B) was 7.3.

As neutral sizing agents there were added to the same beaten pulp as used in raw paper (A) sodium stearate, anion polyacrylamide (Polystron 194-7, available from Arakawa Kagaku Kogyo K.K.), and aluminum sulfate in amounts of 1.0 part, 1.0 part, and 1.5 part by absolute dry weight based on pulp, respectively. The material was then subjected to paper making in the same manner as in raw paper (A) to prepare a raw paper having a weight of 170 g/m$^2$ and a thickness of 166 μm as raw paper (C).

The pH value of raw paper (C) was 3.8 as determined by the hot water extraction process.

Raw paper (D) was prepared in the same manner as in raw paper (C) except that the addition of aluminum sulfate was followed by the addition of sodium aluminate in an amount of 0.5 parts.

The pH value of raw paper (D) was 4.7 as determined by the hot water extraction process.

Onto the surface (light-sensitive material side) of raw papers (A) to (D), a polystyrene containing 10% by weight of titanium oxide and having a density of 0.94 g/cm$^3$ was coated to a thickness of 35 μm by an extrusion coating process. On the other surface of these raw papers a polyethylene having a density of 0.98 g/cm$^3$ was coated to a thickness of 30 μm by an extrusion coating process. Thus, paper supports (A) to (D) were prepared.

EXAMPLE 1

The paper support (A) thus prepared was subjected to corona discharge on the light-sensitive material side. A gelatin subbing layer containing sodium dodecylbenzenesulfonate was then coated on the surface of the paper support thus treated. Various photographic constituent layers were then coated on the subbing layer to prepare a multi-layered color photographic paper 101 having the following layer structure. The coating solutions for these layers were prepared as follows:

Preparation of 1st Layer Coating Solution

To 19.1 g of a yellow coupler (ExY), 4.4 g of a dye image stabilizer (Cpd-1) and 0.7 g of a dye image stabilizer (Cpd-7) were added 27.2 cc of ethyl acetate, 4.1 g of a solvent (Solv-3) and 4.1 g of a solvent (Solv- 7) so that they were dissolved in these solvents. The solution was then emulsion dispersed in 185 cc of a 10% aqueous solution of gelatin containing 8 cc of 10% sodium dodecylbenzenesulfonate to prepare Emulsion Dispersion A. On the other hand, a silver bromochloride emulsion A which comprised a 3:7 molar ratio (as calculated in terms of silver) mixture of a large size emulsion A comprising cubic grains with an average size of 0.88 μm and a grain size distribution fluctuation coefficient of 0.08 and a small size emulsion A having cubic grains with an average size of 0.70 μm and a grain size distribution fluctuation coefficient of 0.10, each emulsion having 0.3 mol. % silver bromide localized on part thereof was prepared. The emulsion comprised blue-sensitizing dyes A and B as described later in amounts of $2.0\times10^{-4}$ mol each for large size emulsion A and $2.5\times10^{-4}$ mol each for small size emulsion B, respectively. The chemical sensitization of the emulsion was effected with a sulfur sensitizer and a gold sensitizer. Emulsion Dispersion A and the silver bromochloride emulsion A were then mixed and dissolved to prepare a 1st layer coating solution having the composition as described later.

The coating solutions for the 2nd to 3rd layers were prepared in the same manner as in the 1st layer coating solution. As gelatin hardener there was added to each of these layers sodium salt of 1-oxy-3,5-dichloro-s-triazine.

To each of these layers was added Cpd-10 and Cpd-11 in amounts of 25.0 mg/m$^2$ and 50.0 mg/m$^2$, respectively.

The silver bromochloride emulsion to be incorporated in the various light-sensitive emulsion layers comprised the following spectral sensitizing dyes:

Sensitizing Dye A for blue-sensitive emulsion layer

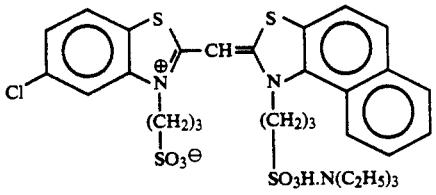

Sensitizing Dye B for blue-sensitive emulsion layer

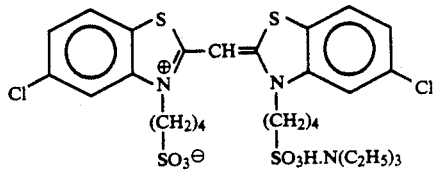

($2.0\times10^{-4}$ mol each for large size emulsion A and $2.5\times10^{-4}$ mol each for small size emulsion B per mol of silver halide)

Sensitizing Dye A for green-sensitive emulsion layer

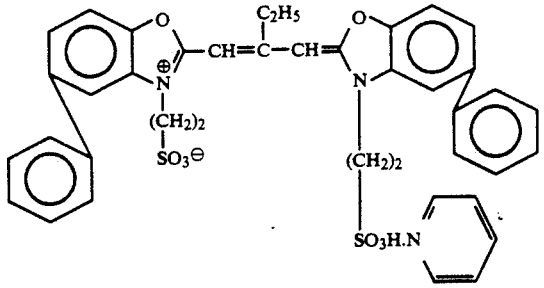

($4.0\times10^{-4}$ mol each for large size emulsion A and $5.6\times10^{-4}$ mol each for small size emulsion B per mol of silver halide)

Sensitizing Dye D for green-sensitive emulsion layer

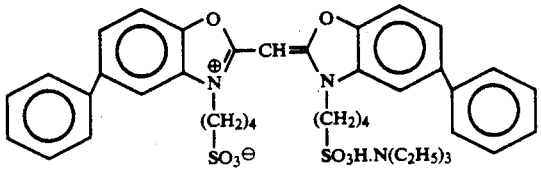

($7.0\times10^{-5}$ mol each for large size emulsion A and $1.0\times10^{-5}$ mol each for small size emulsion B per mol of silver halide)

-continued

Sensitizing Dye E for red-sensitive emulsion layer

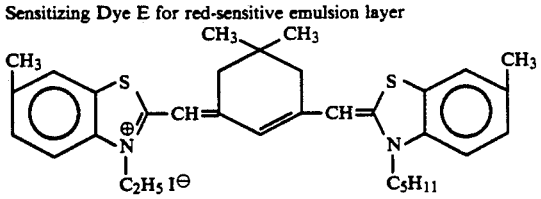

(0.9 × $10^{-4}$ mol each for large size emulsion C and 1.1 × $10^{-4}$ mol each for small size emulsion C per mol of silver halide)

To the red-sensitive emulsion layer was incorporated the following compound in an amount of $2.6\times10^{-3}$ mol per mol of silver halide:

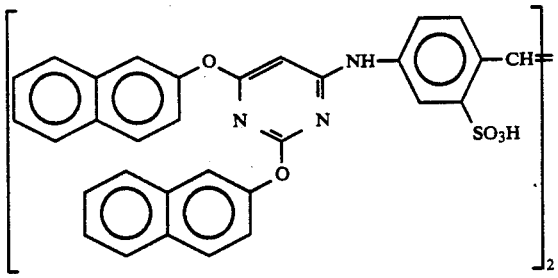

To the blue-sensitive emulsion layer, green-sensitive emulsion layer and red-sensitive emulsion layer were added 1-(5-methylureidephenyl)-5-mercaptotetrazole in amounts of $8.5\times10^{-5}$ mol, $7.7\times10^{-4}$ mol and $2.5\times10^{-4}$ mol per mol of silver halide, respectively.

To the blue-sensitive emulsion layer and green-sensitive emulsion layer were added 4-hydroxy-6-methyl-1,3,3a-tetrazaindene in amounts of $1\times10^{-4}$ mol and $2\times10^{-4}$ mol per mol of silver halide, respectively.

In order to inhibit irradiation, the following dyes were added to these emulsion layers (figure in parenthesis indicates the coated amount).

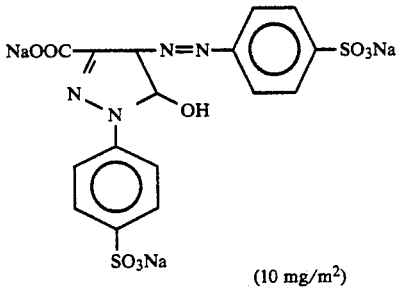

(10 mg/m²)

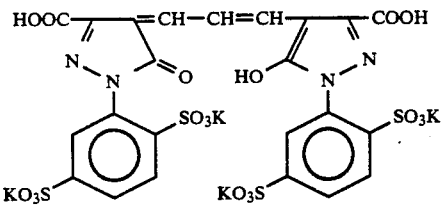

(10 mg/m²)

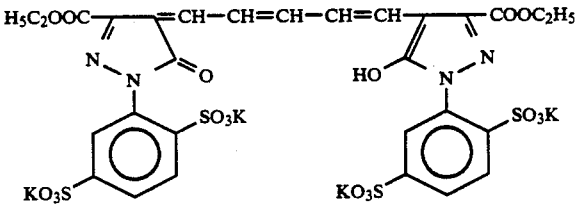

and (40 mg/m²)

-continued

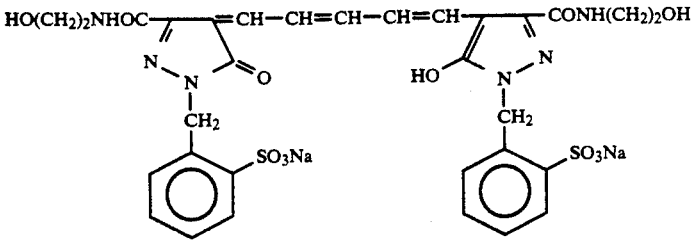

(20 mg/m²)

Layer Structure

The composition of the various layers are set forth below. The figures indicate the coated amount (g/m²). The coated amount of silver halide emulsion is represented as calculated in terms of silver.

| | |
|---|---|
| 1st Layer: blue-sensitive emulsion layer | |
| Silver bromochloride emulsion A as set forth above | 0.30 |
| Gelatin | 1.86 |
| Yellow coupler (ExY) | 0.82 |
| Dye image stabilizer (Cpd-1) | 0.19 |
| Solvent (Solv-3) | 0.16 |
| Solvent (Solv-7) | 0.16 |
| Dye image stabilizer (Cpd-7) | 0.06 |
| 2nd Layer: color stain inhibiting layer | |
| Gelatin | 0.99 |
| Color stain inhibitor (Cpd-5) | 0.08 |
| Solvent (Solv-1) | 0.16 |
| Solvent (Solv-4) | 0.08 |
| 3rd Layer: green-sensitive emulsion layer | |
| Silver bromochloride emulsion (1:3 (molar ratio as calculated in terms of silver) mixture of a large size emulsion B comprising cubic grains with an average size of 0.55 μm and a grain size distribution fluctuation coefficient of 0.10 and a small size emulsion B having cubic grains with an average size of 0.39 μm and a grain size distribution fluctuation coefficient of 0.08, each emulsion having 0.8 mol % silver bromide localized on part thereof) | 0.12 |
| Gelatin | 1.24 |
| Magenta coupler (ExM) | 0.23 |
| Dye image stabilizer (Cpd-2) | 0.03 |
| Dye image stabilizer (Cpd-3) | 0.16 |
| Dye image stabilizer (Cpd-4) | 0.02 |
| Dye image stabilizer (Cpd-9) | 0.02 |
| Solvent (Solv-2) | 0.40 |
| 4th Layer: ultraviolet-absorbing layer | |
| Gelatin | 1.58 |
| Ultraviolet absorbent (UV-1) | 0.47 |
| Color stain inhibitor (Cpd-5) | 0.05 |
| Solvent (Solv-5) | 0.24 |
| 5th Layer: red-sensitive emulsion layer | |
| Silver bromochloride emulsion (1:4 (molar ratio as calculated in terms of silver) mixture of a large size emulsion C comprising cubic grains with an average size of 0.58 μm and a grain size distribution fluctuation coefficient of 0.09 and a small size emulsion C having cubic grains with an average size of 0.45 μm and a grain size distribution fluctuation coefficient of 0.11, each emulsion having 0.6 mol % silver bromide localized on part thereof) | 0.23 |

-continued

| | |
|---|---|
| Gelatin | 1.34 |
| Cyan coupler (ExC) | 0.32 |
| Dye image stabilizer (Cpd-2) | 0.03 |
| Dye image stabilizer (Cpd-4) | 0.02 |
| Dye image stabilizer (Cpd-6) | 0.18 |
| Dye image stabilizer (Cpd-7) | 0.40 |
| Dye image stabilizer (Cpd-8) | 0.05 |
| Solvent (Solv-6) | 0.14 |
| 6th Layer: ultraviolet-absorbing layer | |
| Gelatin | 0.53 |
| Ultraviolet absorbent (UV-1) | 0.16 |
| Color stain inhibitor (Cpd-5) | 0.02 |
| Solvent (Solv-5) | 0.08 |
| 7th Layer: protective layer | |
| Gelatin | 1.33 |
| Acryl-modified copolymer of polyvinyl alcohol (modification degree: 17%) | 0.17 |
| Liquid paraffin | 0.03 |

Yellow coupler (ExY)

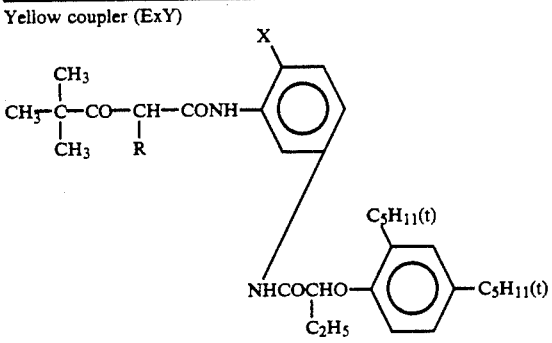

Magenta coupler (ExM)

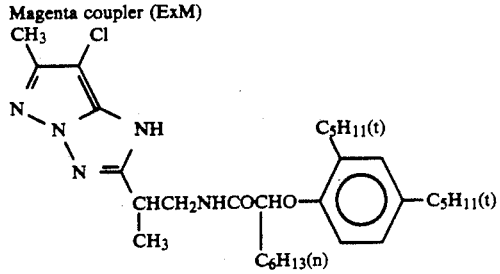

Cyan coupler (ExC)
1:1 Mixture (molar ratio) of:

-continued

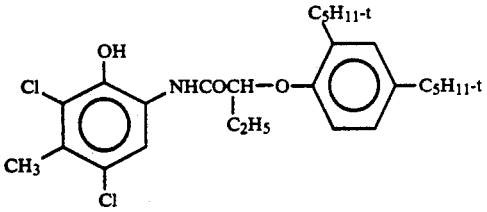

and

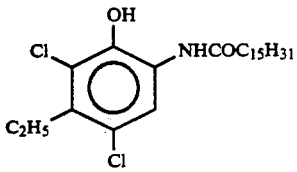

Dye image stabilizer (Cpd-1)

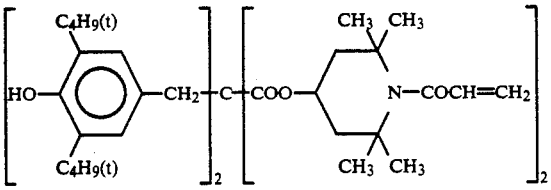

Dye image stabilizer (Cpd-2)

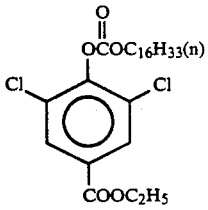

Dye image stabilizer (Cpd-3)

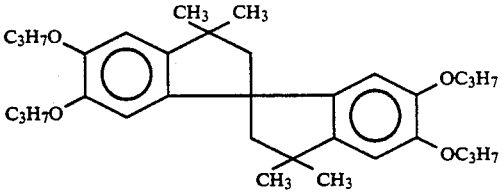

Dye image stabilizer (Cpd-4)

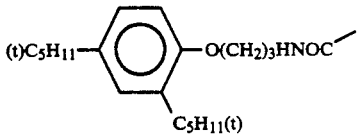

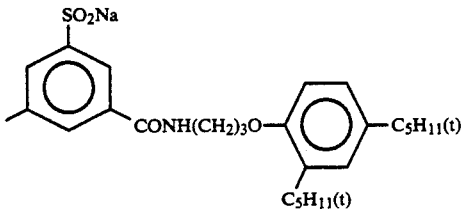

Color stain inhibitor (Cpd-5)

-continued

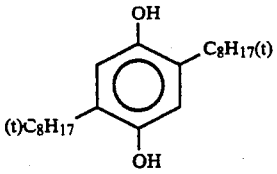

Dye image stabilizer (Cpd-6)
2:4:4 Mixture (by weight) of:

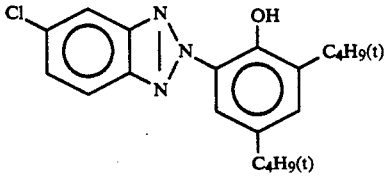

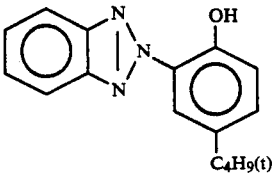

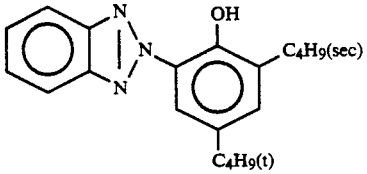

Dye image stabilizer (Cpd-7)

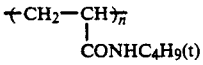

Average (molecular weight 60,000)

Dye image stabilizer (Cpd-8)
1:1 Mixture (by weight) of:

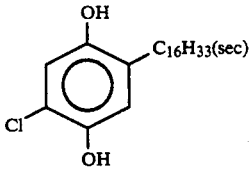

and

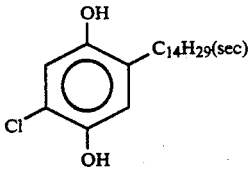

Dye image stabilizer (Cpd-9)

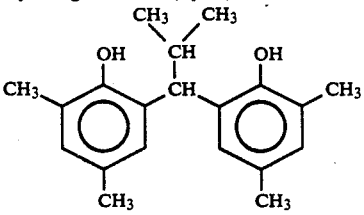

Preservative (Cpd-10)

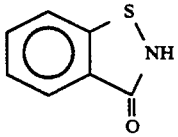

Preservative (Cpd-11)

-continued

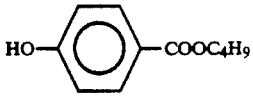

Ultraviolet absorbent (UV-1)
4:2:4 Mixture (by weight) of:

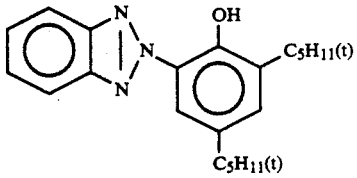

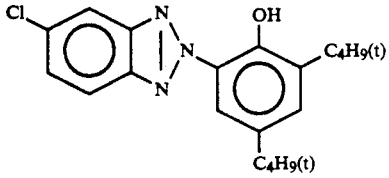

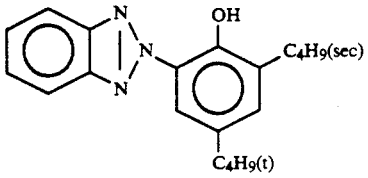

Solvent (Solv-1)

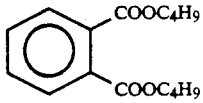

Solvent (Solv-2)
1:1 Mixture (by volume) of:

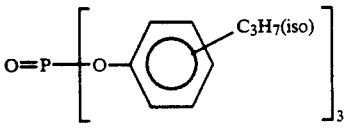

and

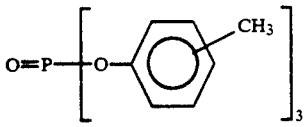

Solvent (Solv-3)
$O{=}P{+}O{-}C_9H_{19}(iso)]_3$

Solvent (Solv-4)

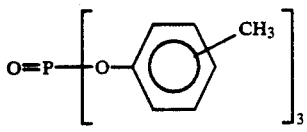

Solvent (Solv-5)

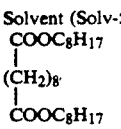

Solvent (Solv-6)

80:20 Mixture (by volume) of:

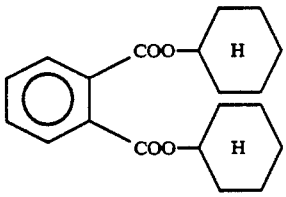

and

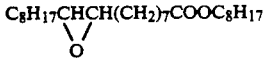

Solvent (Solv-7)

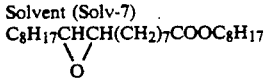

These specimens were then subjected to gradient exposure through a separation filter for sensitometry by means of a sensitometer (Model FEH; color temperature of light source: 3,200° K.; available from Fuji Photo Film Co., Ltd.). This exposure was effected in such a manner that the exposure reached 250 CMS for 0.1 second.

The specimens which have been exposed were then subjected to continuous processing (running test) with the following processing solutions in the following processing steps by means of a paper processing machine until the replenishment reached twice the capacity of the color developer tank.

| Processing step | Temperature | Time | Replenishment rate* | Tank capacity |
|---|---|---|---|---|
| Color development | 35° C. | 45 sec. | 161 ml | 17 l |
| Blix | 30–35° C. | 45 sec. | 215 ml | 17 l |
| Water wash 1 | 30–35° C. | 20 sec. | — | 10 l |
| Water wash 2 | 30–35° C. | 20 sec. | — | 10 l |
| Water wash 3 | 30–35° C. | 20 sec. | 350 ml | 10 l |
| Drying | 70–80° C. | 60 sec. | | |

*per $m^2$ of light-sensitive material

The Water whaing step was effected in a countercurrent process wherein the washing solution flows backward.

The various processing solutions had the following compositions:

| Color developer | Running solution | Replenisher |
|---|---|---|
| Water | 800 ml | 800 ml |
| Ethylenediamine-N,N,N',N'-tetraphosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamideethyl)-3-methyl-4-aminoaniline sulfate | 5.0 g | 7.0 g |
| N,N-bis(carboxymethyl)-hydrazine | 4.0 g | 5.0 g |
| N,N-di(sulfoethyl)-hydroxylamine.lNa | 4.0 g | 5.0 g |
| Fluorescent brightening agent (WHITEX 4B, available from Sumitomo Chemical Co., Ltd.) | 1.0 g | 2.0 g |

-continued

| | | |
|---|---|---|
| Water to make | 1,000 ml | 1,000 ml |
| pH (25° C.) | 10.05 | 10.45 |
| Blix solution (Running solution was used also as replenisher) | | |
| Water | | 400 ml |
| 70% Ammonium thiosulfate | | 100 ml |
| Sodium sulfite | | 17 g |
| Ferric ammonium ethylene diamine-tetraacetate | | 55 g |
| Disodium ethylenediaminetetraacetate | | 5 g |
| Ammonium bromide | | 40 g |
| Water to make | | 1,000 ml |
| pH (25° C.) | | 6.0 |
| Water washing solution (Running solution was used also as replenisher) | | |
| Ion-exchanged water (calcium and magnesium concentration: 3 ppm each) | | |

Specimens 102 to 122 were prepared in the same manner as in Specimen 101 except that paper support, magenta coupler and yellow coupler were altered as shown in Table 1 (couplers were replaced in equimolecular amounts).

These specimens were measured for density through blue, green and red filters by means of a reflective densitometer. The magenta dye density was evaluated for maximum density ($D^G_{max}$) and fog ($D^G_{min}$).

An image was printed on these specimens from a negative film on which a color checker (available from Macbeth) with the hue of the gray portion adjusted. The color reproducibility on each hue as organoleptically evaluated. E indicates sharp hue, and P indicates hue apparently poorer than E.

Yellow-colored specimens were stored at a temperature of 60° C. and a relative humidity of 70% for 6 months. The magnitude of color stain is represented by the change in green filter density $\Delta D^G$ at the initial blue filter density $D_oB$ of 2.0. The results are set forth in Table 1.

Comparative Coupler (A)

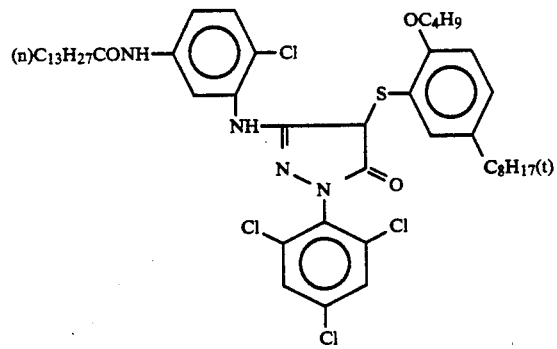

Comparative Coupler (B)

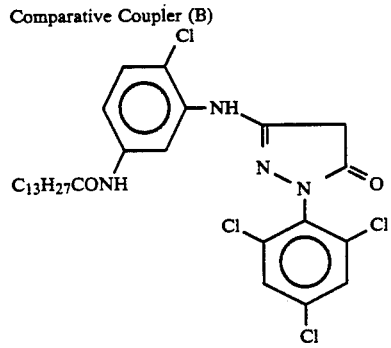

Table 1 shows that the specimens of the present invention are excellent in $D^G_{max}$, fog ($D^G_{min}$), color reproducibility and color reproducibility after storage under wet heat condition. In particular, Comparative Specimens 101 to 104 exhibit little color stain after prolonged storage but are poorer than the present specimens in yellow and green color reproducibility. Com-

TABLE 1

| Specimen No. | Paper support (base pH) | Magenta coupler (relative coupling rate) | Yellow coupler | $D^G_{max}$ | $D^G_{min}$ | Color reproducibility Y | M | R | G | $\Delta D^G$ |
|---|---|---|---|---|---|---|---|---|---|---|
| 101 | A (6.4) | I-38 (0.22) | ExY | 2.52 | 0.08 | P | E | E | P | 0.21 |
| 102 | B (7.3) | " | " | " | " | P | E | E | P | 0.21 |
| 103 | C (3.8) | " | " | 2.51 | " | P | E | E | P | 0.28 |
| 104 | D (4.7) | " | " | 2.52 | " | P | E | E | P | 0.25 |
| 105 | C | " | Y-2 | 2.51 | " | E | E | E | E | 0.41 |
| 106 | D | " | " | " | " | E | E | E | E | 0.40 |
| 107 | A | Comparative Coupler A (0.76) | " | 2.03 | 0.09 | E | P | P | E | 0.41 |
| 108 | C | Comparative Coupler A (0.76) | " | 2.02 | " | E | P | P | E | 0.40 |
| 109 | A | Comparative Coupler B (0.70) | " | 2.02 | " | E | P | P | E | 0.42 |
| 110 | C | Comparative Coupler B (0.70) | Y-2 | 2.01 | 0.09 | E | P | P | E | 0.42 |
| 111 | C | Comparative Coupler B (0.70) | ExY | 2.01 | 0.10 | E | P | P | P | 0.41 |
| 112 | D | Comparative Coupler B (0.70) | " | 2.00 | 0.09 | P | P | P | P | 0.41 |
| 113 | A | I-38 | Y-2 | 2.52 | 0.08 | E | E | E | E | 0.20 |
| 114 | B | I-38 | Y-2 | 2.53 | 0.08 | E | E | E | E | 0.19 |
| 115 | A | " | Y-1 | 2.52 | " | E | E | E | E | 0.20 |
| 116 | B | " | " | 2.52 | " | E | E | E | E | 0.19 |
| 117 | A | I-7 (0.30) | Y-2 | 2.53 | " | E | E | E | E | 0.20 |
| 118 | A | " | Y-12 | 2.53 | " | E | E | E | E | 0.20 |
| 119 | B | I-38 | Y-1 | 2.52 | " | E | E | E | E | 0.19 |
| 120 | B | " | Y-8 | 2.53 | " | E | E | E | E | 0.19 |
| 121 | A | I-7 | Y-15 | 2.54 | " | E | E | E | E | 0.20 |
| 122 | B | " | " | 2.53 | " | E | E | E | E | 0.19 |

(Note: Specimens 101 to 102 and 113 to 122 are according to the present invention. Specimens 103 to 112 are comparative.)

parative Specimens 105 and 106 are excellent in $D^G_{max}$ and color reproduction shortly after fogging but exhibit a great color stain after prolonged storage, remarkably marring the color reproducibility. Comparative Specimens 107 to 112 are poorer than the present specimens in $D^G_{max}$, fog, color reproducibility, and color reproducibility after prolonged storage.

EXAMPLE 2

A multi-layer color photographic paper specimen 201 was prepared in the same manner as in Specimen No. M described in Example 1 in EP 355,660A2 except that as support there was used the above mentioned paper support (A) and that the following alteration was made:

To the red-sensitive emulsion layer was added the following mercaptoimidazole compound and mercaptothiadiazole compound in amounts of $2\times10^{-4}$ mol and $4\times10^{-4}$ mol per mol of silver halide, respectively.

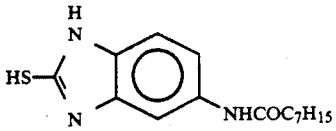

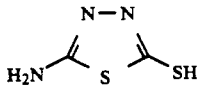

In order to inhibit irradiation, the following dyes were incorporated in the emulsion layers:

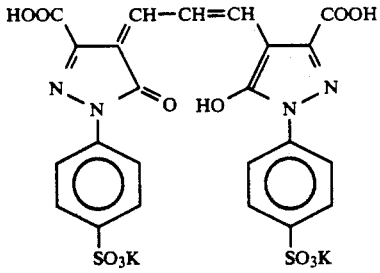

(7.0 × $10^{-6}$ mol/m²)

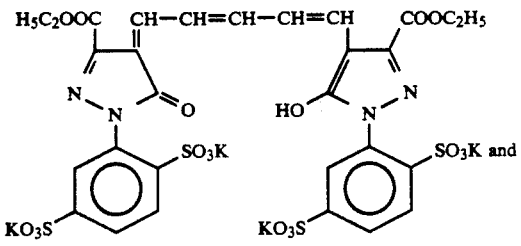

(1.4 × $10^{-5}$ mol/m²)

-continued

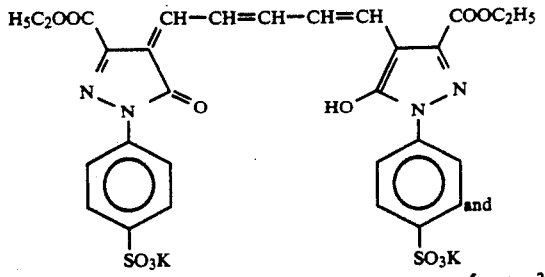

(1.4 × $10^{-5}$ mol/m²)

In order to inhibit decomposition and the proliferation of mold, the following compounds were incorporated in all emulsions for the 1st to 7th layers:

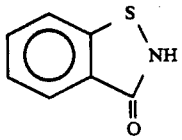

(25 mg/m²)

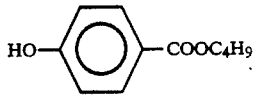

(25 mg/m²)

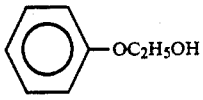

(500 mg/m²)

Specimens 202 to 222 were prepared by using the same paper support, magenta coupler and yellow coupler as used in Example 1. These specimens were processed by the processing method as described in Example 1 in the above cited EPO 355660A2.

Specimens 201 to 222 thus obtained were then evaluated in the same manner as in Example 1. The results were similar to that in Example 1.

EXAMPLE 3

Effect of Neutral Paper Support for Inhibiting Magenta Color Stain

Specimen 301 was prepared in the same manner as in Specimen 101 except that the 1st layer (blue-sensitive layer) was altered as described later and the magnet coupler to be incorporated in the 3rd layer (green-sensitive layer) was altered to I-7.

| 1st Layer: blue-sensitive emulsion layer | |
|---|---|
| Silver bromochloride emulsion A as mentioned above | 0.28 |
| Gelatin | 1.23 |
| Yellow coupler (ExY) | 0.68 |
| Solvent (Solv-7) | 0.26 |
| Dye image stabilizer (Cpd-1) | 0.10 |
| Dye image stabilizer (Cpd-7) | 0.10 |
| Dye image stabilizer (Cpd-9) | 0.25 |
| Dye image stabilizer (Cpd-12) | 0.10 |

The coating solution for the 1st layer was prepared by dissolving the coupler, solvent, and dye image stabilizers in ethyl acetate to form an emulsion in the same manner as in Example 1. The emulsion was then coated on the support in the same manner as in Example 1.

Another specimen was prepared in the same manner as in Specimen 301 except that the paper support and the couplers to be incorporated in the 1st and 3rd layers were altered as set forth in Table 2.

These specimens were yellow-colored, and then stored at a temperature of 80° C and a relative humidity of 70% for 20 days in the same manner as in Example 1. The magnitude of magenta color stain at yellow-colored portion during storage after processing is represented by the change in green filter density (ΔDG) at the initial blue filter DBO of 2.0.

TABLE 2

| Specimen No. | Paper support (raw paper pH) | Magenta coupler | Yellow coupler | Magenta color stain $\Delta D^G$ |
|---|---|---|---|---|
| 301 | A(6.4) | I-7 | ExY | 0.18 |
| 302 | B(7.3) | I-7 | ExY | 0.17 |
| 303 | C(3.8) | I-7 | ExY | 0.26 |
| 304 | D(4.7) | I-7 | ExY | 0.25 |
| 305 | E(5.7) | I-7 | ExY | 0.18 |
| 306 | F(8.4) | I-7 | ExY | 0.17 |
| 307 | G(9.3) | I-7 | ExY | 0.23 |
| 308 | A(6.4) | I-38 | Y-1 | 0.20 |
| 309 | B(7.3) | I-38 | Y-1 | 0.19 |
| 310 | C(3.8) | I-38 | Y-1 | 0.36 |
| 311 | D(4.7) | I-38 | Y-1 | 0.32 |
| 312 | E(5.7) | I-38 | Y-1 | 0.20 |
| 313 | F(8.4) | I-38 | Y-1 | 0.21 |
| 314 | G(9.3) | I-38 | Y-1 | 0.29 |
| 315 | A(6.4) | I-5 | Y-12 | 0.21 |
| 316 | B(7.3) | I-5 | Y-12 | 0.19 |
| 317 | C(3.8) | I-5 | Y-12 | 0.39 |
| 318 | D(4.7) | I-5 | Y-12 | 0.36 |
| 319 | E(5.7) | I-5 | Y-12 | 0.20 |
| 320 | F(8.4) | I-5 | Y-12 | 0.21 |
| 321 | G(9.3) | I-5 | Y-12 | 0.30 |

(Note: Specimens 301, 302, 305, 306, 308, 309, 312, 313, 315, 316, 319, and 320 are according to the present invention. The other specimens are comparison.)

EXAMPLE 4

Specimens were prepared in the same manner as in Example 3 except that the coupler solvent to be incorporated in the 1st layer (blue-sensitive emulsion layer), yellow coupler, coupler solvent (oil)/yellow coupler (Y-Cp) ratio (weight) and magenta coupler were altered as set forth in Table 3. These specimens were evaluated in the same manner as in Example 3.

TABLE 3

| Specimen No. | Paper support (base pH) | Magenta coupler | Yellow coupler | Oil/ Y-Cp | Magenta color stain $\Delta D^G$ |
|---|---|---|---|---|---|
| 401 | A(6.4) | I-38 | ExY | 0.48 | 0.29 |
| 402 | A(6.4) | I-38 | ExY | 0.43 | 0.25 |
| 403 | A(6.4) | I-38 | ExY | 0.40 | 0.21 |
| 404 | A(6.4) | I-38 | ExY | 0.38 | 0.20 |
| 405 | A(6.4) | I-38 | ExY | 0.34 | 0.20 |
| 406 | A(6.4) | I-38 | ExY | 0.30 | 0.20 |
| 407 | A(6.4) | I-38 | ExY | 0.25 | 0.20 |
| 408 | A(6.4) | I-38 | ExY | 0.20 | 0.20 |
| 409 | B(7.3) | I-38 | ExY | 0.48 | 0.27 |
| 410 | B(7.3) | I-38 | ExY | 0.40 | 0.20 |
| 411 | B(7.3) | I-38 | ExY | 0.34 | 0.20 |
| 412 | B(7.3) | I-38 | ExY | 0.20 | 0.19 |
| 413 | A(6.4) | I-38 | Y-12 | 0.48 | 0.36 |
| 414 | A(6.4) | I-38 | Y-12 | 0.43 | 0.30 |
| 415 | A(6.4) | I-38 | Y-12 | 0.40 | 0.22 |
| 416 | A(6.4) | I-38 | Y-12 | 0.30 | 0.20 |
| 417 | A(6.4) | I-38 | Y-12 | 0.20 | 0.20 |
| 418 | A(6.4) | I-38 | Y-12 | 0.10 | 0.20 |
| 419 | A(6.4) | I-38 | Y-12 | 0.00 | 0.19 |
| 420 | B(7.3) | I-5 | Y-12 | 0.48 | 0.39 |
| 421 | B(7.3) | I-5 | Y-12 | 0.38 | 0.22 |
| 422 | B(7.3) | I-5 | Y-12 | 0.20 | 0.20 |
| 423 | B(7.3) | I-5 | Y-12 | 0.10 | 0.20 |

(Note: Specimens 403 to 408, 410 to 412, 415 to 419, and 421 to 423 are according to the present invention. The other specimens are comparison.)

In accordance with the present invention, color photographs excellent in maximum color density, fogging, color reproducibility, and color reproducibility after storage under wet heat condition can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a paper support having thereon a photographic substituent layer comprising at least one yellow coupler-containing layer, at least one magenta coupler-containing layer, and at least one cyan coupler-containing layer, wherein (i) said magenta coupler is selected from among formula (Ia), (Id), and (Ie); (ii) the weight ratio of a high-boiling point organic solvent in the same layer as said yellow coupler to said yellow coupler is b 0.40 or less; and (iii) the pH of raw paper comprising said support is in the range of 5 to 9:

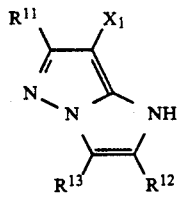
(Ia)

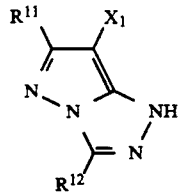
(Id)

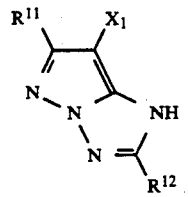
(Ie)

wherein $R^{11}$, $R^{12}$ and $R^{13}$ may be the same or different and each represents a hydrogen atom, halogen atom, alkyl group, aryl group, heterocyclic group, cyano group, alkoxy group, aryloxy group, heterocyclic oxy group, acyloxy group, carbamoyloxy group, silyloxy group, sulfonyloxy group, acylamino group, anilino group, ureide group, imide group, sulfamoylamino group, carbamoylamino group, alkylthio group, arylthio group, heterocyclic thio group, alkoxycarbonylamino group, aryloxycarbonylamino group, sulfonamide group, carbamoyl group, acyl group, sulfamoyl group, sulfonyl group, sulfinyl group, alkoxycarbonyl group, or aryloxycarbonyl group; $X_1$ represents a halogen atom, carboxyl group or a group which is connected to the carbon atom in the coupling-position via an oxygen atom, nitrogen atom or sulfur atom and can be released therefrom upon coupling reaction, with the proviso that $R^{11}$, $R^{12}$, $R^{13}$ or $X_1$ may form a dimer or a higher polymer.

2. A silver halide color photographic material as claimed in claim 1, wherein at least one of said yellow couplers is represented by the general formula (II):

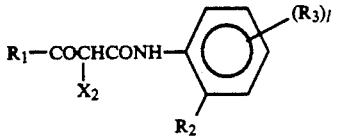

(II)

wherein $R_1$ represents an aryl group or tertiary alkyl group; $R_2$ represents a fluorine atom, alkyl group, aryl group, alkoxy group, aryloxy group, dialkylamino group, alkylthio group or arylthio group; $R_3$ represents a substituent group for a benzene ring; $X_2$ represents a hydrogen atom or a group releasable upon coupling reaction with an oxidation product of an aromatic primary amine developing agent; and l represents 0, 1, 2, 3 or 4, with the proviso that if l is plural, the plurality of $R_3$'s may be the same or different.

3. A silver halide color photographic material as claimed in claim 1, wherein the relative coupling rate of said magenta coupler is in the range of 0.1 to 1.0.

4. A silver halide color photographic material as claimed in claim 1, wherein the pH value of raw paper support is in the range of 5.5 to 8.5.

5. A silver halide color photographic material as claimed in claim 1, wherein a weight ratio of a high boiling organic solvent in the same layer as said yellow coupler to said yellow coupler is in the range of 0.2 to 0.38.

6. A silver halide color photographic material as claimed in claim 1, wherein said magenta coupler is represented by the general formula (Ie).

7. The silver halide color photographic material as claimed in claim 2, wherein said yellow coupler is represented by formula (II) where $R_1$ is $C_{6-24}$ aryl group, or $C_{4-26}$ tertiary alkyl group; $R_2$ is a fluorine atom, $C_{1-24}$ alkyl group, $C_{6-24}$ aryl group, $C_{1-24}$ alkoxy group, $C_{6-24}$ aryloxy group, $C_{2-24}$ dialkylamino group, $C_{1-24}$ alkylthio group, or $C_{6-24}$ arylthio group; $R_3$ is a halogen atom, $C_{1-24}$ alkyl group, $C_{6-24}$ aryl group, $C_{1-24}$ alkoxy group, $C_{6-24}$ aryloxy group, $C_{2-24}$ alkoxycarbonyl group, $C_{7-24}$ aryloxycarbonyl group, $C_{1-24}$ carbonamide group, $C_{1-24}$ sulfonamide group, $C_{1-24}$ carbamoyl group, $C_{0-24}$ sulfamoyl group, $C_{1-24}$ alkylsulfonyl group, $C_{6-24}$ arylsulfonyl group, $C_{1-24}$ ureide group, $C_{0-24}$ sulfamoylamino group, $C_{2-24}$ alkoxycarbonylamino group, nitro group, $C_{1-24}$ alkylsulfonyloxy group, or $C_{6-24}$ arylsulfonyloxy group, l is 1 or 2, and $X_2$ is a heterocyclic group which is connected to the coupling active position via nitrogen atom or an aryloxy group.

8. The silver halide color photographic material according to claim 1, wherein said high boiling organic solvent is selected from among

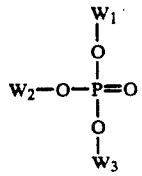

(A)

$W_1-COO-W_2$ (B)

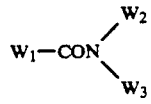

(C)

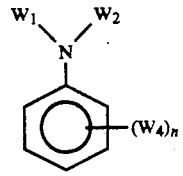

(D)

$W_1-O-W_2$ (E)

wherein $W_1$, $W_2$ and $W_3$ each represents a substituted or unsubstituted alkyl group, cycloalkyl group, alkenyl group, aryl group or heterocyclic group; $W_4$ represents $W_1$, $OW_1$ or $S-W_1$; and n is 1 to 5 with the provisos that when n is greater than 1, the plurality of $W_4$'s may be the same or different and further wherein, $W_1$ and $W_2$ of formula (E) may together form a condensed ring.

9. The silver halide color photographic material as claimed in claim 1, wherein the solvent comprises a compound having a melting point of not greater than 100° C. and a boiling point of not less than about 140° C. and which is scarcely miscible with water and can effectively dissolve at least one coupler therein.

10. The silver halide color photographic material as claimed in claim 1, wherein the cyan coupler is selected from among compounds represented by the following:

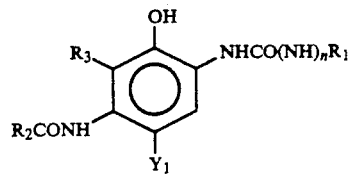

(C-I)

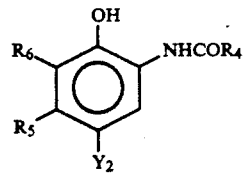

(C-II)

wherein $R_1$, $R_2$ and $R_4$ each represents a substituted or unsubstituted aliphatic, aromatic or heterocyclic group and $R_3$, $R_5$ and $R_6$ each represents a hydrogen atom, halogen atom, aliphatic group, aromatic group or acylamino group with the proviso that $R_3$ may represent an atomic group which forms a 5- or 6-membered nitrogen-containing ring with $R_2$; $Y_1$ and $Y_2$ each represents a hydrogen atom or a group releasable upon coupling reaction with an oxidation product of a developing agent and n represents 0 or 1.

11. The silver halide color photographic material as claimed in claim 1, wherein at least one of the yellow coupler-containing layer, the magenta coupler-containing layer and the green coupler-containing layer comprises a high silver chloride emulsion having the silver chloride content of 90 mol. % or more.

12. The silver halide color photographic material according to claim 7 wherein $R^3$ represents fluorine, chlorine, bromine, iodine, methyl, t-butyl, n-dodecyl, phenyl, p-tolyl, p-dodecyloxyphenyl, methoxy, n-butoxy, n-octyloxy, n-tetradecyloxy, benzyloxy, methoxyethoxy, phenoxy, p-t-butylphenoxy, 4-butoxyphenoxy, ethoxycarbonyl, dodecyloxycarbonyl, 1-(dodecyloxycarbonyl)ethoxycarbonyl, phenoxycarbonyl, 4-t-octylphenoxycarbonyl, 2,4di-t-pentylphenoxycarbonyl, acetamide, pivaloylamino, benzamide, 2-ethylhexanamide, tetradecanamide, 1-(2,4-di-t-pentylphenoxy) butanamide, 3-(2,4-di-t-pentylphenoxy)-butanamide, 3-dodecylsulfonyl-2-methylpropanamide, methanesulfonamide, p-toluenesulfonamide, hexadecansulfonamide, N-methylcarbamoyl, N-tetradecylcarbamoyl, N,N-dihexylcarbamoyl, N-octadecyl-N-methylcarbamoyl, N-phenylcarbamoyl, N-methylsulfamoyl, N-phenylsulfamoyl, N-acetylsulfamoyl, N-propanoylsulfamoyl, N-hexadecylsulfamoyl, N,N-dioctylsulfamoyl, methylsulfonyl, benzylsulfonyl, hexadecylsulfonyl, phenylsulfonyl, p-tolylsulfonyl, p-dodecylsulfonyl, p-methoxysulfonyl, 3-methylureide, 3-phenylureide, 3,3-dimethylureide, 3-tetradecylureide, N,N-dimethylsulfamoylamino, methoxycarbonylamino, isobutoxycarbonylamino, dodecyloxycarbonylamino, 4-pyridyl, 2-thenyl, phthalimide, octadecylsuccinimidey, acetyl, benzoyl, dodecanoyl, acetoxy, benzoyloxy, dodecanoyloxy, methylsulfonyloxy, hexadecylsulfonyloxy, p-toluenesulfonyloxy, p-dodecylphenylsulfonyloxy.

13. A silver halide color photographic material comprising, a paper support having thereon, at least each one of a yellow coupler-containing layer, a magenta coupler-containing layer and a cyan coupler-containing layer, wherein said magenta coupler is represented by formula (I) and said yellow coupler is represented by formula (II) wherein the pH value of raw paper constituting said support is in the range of 5 to 9:

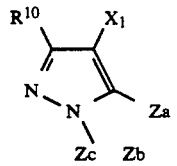

(I)

wherein $R^{10}$ represents a hydrogen atom or substituent group; $X_1$ represents a group which is releasable upon coupling reaction with an oxidation product of an aromatic primary amine developing agent; and Za, Zb and Zc each represents a methine, substituted methine, =N— or —NH— group, with the proviso that one of Za-Zb bond and Zb-Zc bond is a double bond and the other a single bond, further wherein if Zb-Zc bond is a carbon-carbon double bond, it may be a part of the aromatic ring, and that $R^{10}$ or $X_1$ may form a dimer or higher polymer or, if Za, Zb or Zc is a substituted methine, it may form a dimer or higher polymer and

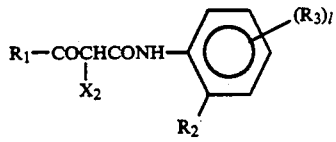

(II)

wherein $R_1$ represents an aryl group or tertiary alkyl group; $R_2$ represents a fluorine atom, alkyl group, aryl group, alkoxy group, aryloxy group, dialkylamino group, alkylthio group or arylthio group; $R_3$ represents a substituent group for a benzene ring; $X_2$ represents a hydrogen atom or a group releasable upon coupling reaction with an oxidation product of an aromatic primary amine developing agent; and l represents 0, 1, 2, 3 or 4, with the proviso that if l is plural, the plurality of $R_3$'s may be the same or different.

14. A silver halide color photographic material as claimed in claim 13, wherein the pH value of raw paper support is in the range of 5.5 to 8.5.

15. A silver halide color photographic material as claimed in claim 13, wherein a weight ratio of a high boiling organic solvent in the same layer as said yellow coupler to said yellow coupler is in the range of 0.2 to 0.38.

16. The silver halide color photographic material as claimed in claim 13, wherein said yellow coupler is represented by formula (II) where $R_1$ is $C_{6-24}$ aryl group, or $C_{4-26}$ tertiary alkyl group; $R_2$ is a fluorine atom, $C_{1-24}$ alkyl group, $C_{6-24}$ aryl group, $C_{1-24}$ alkoxy group, $C_{6-24}$ aryloxy group, $C_{2-24}$ dialkylamino group, $C_{1-24}$ alkylthio group, or $C_{6-24}$ arylthio group; $R_3$ is a halogen atom, $C_{1-24}$ alkyl group, $C_{6-24}$ aryl group, $C_{1-24}$ alkoxy group, $C_{6-24}$ aryloxy group, $C_{2-24}$ alkoxycarbonyl group, $C_{7-24}$ aryloxycarbonyl group, $C_{1-24}$ carbonamide group, $C_{1-24}$ sulfonamide group, $C_{1-24}$ carbamoyl group, $C_{0-24}$ sulfamoyl group, $C_{1-24}$ alkylsulfonyl group, $C_{6-24}$ arylsulfonyl group, $C_{1-24}$ ureide group, $C_{0-24}$ sulfamoylamino group, $C_{2-24}$ alkoxycarbonylamino group, nitro group, $C_{1-24}$ alkylsulfonyloxy group, or $C_{6-24}$ arylsulfonyloxy group, l is 1 or 2, and $X_2$ is a heterocyclic group which is connected to the coupling active position via nitrogen atom or an aryloxy group.

17. The silver halide color photographic material as claimed in claim 13, wherein the solvent comprises a compound having a melting point of not greater than 100° C. and a boiling point of not less than about 140° C. and which is scarcely miscible with water and can effectively dissolve at least one coupler therein.

18. The silver halide color photographic material as claimed in claim 13, wherein at least one of the yellow coupler-containing layer, the magenta coupler-containing layer and the green coupler-containing layer comprises a high silver chloride emulsion having the silver chloride content of 90 mol. % or more.

* * * * *